US006601825B2

(12) United States Patent
Bressner et al.

(10) Patent No.: US 6,601,825 B2
(45) **Date of Patent: *Aug. 5, 2003**

(54) PORTABLE AND DEMOUNTABLE LIFTING DEVICE

(75) Inventors: Eric Bressner, Winston, GA (US); Jared Davis, Winston, GA (US)

(73) Assignee: Alum-A-Lift, Inc., Winston, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/151,228

(22) Filed: May 20, 2002

(65) Prior Publication Data

US 2002/0134970 A1 Sep. 26, 2002

Related U.S. Application Data

(63) Continuation-in-part of application No. 09/790,920, filed on Feb. 22, 2001, now Pat. No. 6,390,450.

(51) Int. Cl.[7] ..... B25B 1/00

(52) U.S. Cl. ..... 254/4 R; 254/4 B; 254/89 H; 254/2 R

(58) Field of Search ..... 254/48, 127, 128, 254/93 H, 8 R, 89 H, 8 B, 4 R, 2 R

(56) References Cited

U.S. PATENT DOCUMENTS 2,222,243 A * 11/1940 Sandstrom ..... 254/8 B
3,385,401 A * 5/1968 Campbell et al. ..... 254/8 R
4,789,349 A * 12/1988 Parmer ..... 403/340
5,269,501 A * 12/1993 Liegel et al. ..... 254/8 B
6,390,450 B1 * 5/2002 Bressner et al. ..... 254/4 B

* cited by examiner

*Primary Examiner*—Lee Wilson
(74) *Attorney, Agent, or Firm*—Michael J. Mehrman; Gardner Groff & Mehrman, P.C.

(57) ABSTRACT

A lifting device that can effectively lift a variety of objects and enhance portability. The lifting device provides demountable portability that enables easy adaptation of the invention for objects of varying size. This adaptability provides a universality that minimizes the number of lifting devices need. The demountable nature of the invention also aids in efficient storage. Generally described, the lifting device includes a mast separable into a plurality of sections and a pulley supported by a first section of the mast. A dolly that supports the mast includes one or more transport structures for movably supporting the lifting device. An actuator is mounted on a second section of the mast. A carriage captured on the mast is configured to slide along the mast and directly or indirectly support an object to be lifted. The lifting device also includes a belt with a first end and a second end. The first end attaches to the carriage and the second end attaches to the actuator so that the belt extends over the pulley. The actuator selectively reels the belt in and out when the belt is positioned over the pulley. This causes the carriage to move up and down along the mast. The belt is removable from the pulley. The first section of the mast is removable from the second section of the mast when the belt is removed from the pulley. This provides the lift with demountable portability.

20 Claims, 26 Drawing Sheets

MAST SCARF JOINT

SADDLE MOUNT BASE JOINT

SADDLE MOUNT, WITH MAST INSERTED

BASE ASSEMBLY WITH WELDED-IN MAST SECTION

BASE ASSEMBLY WITH WELDED-IN SCARF-JOINT MAST SECTION

BASE WITH SINGLE OVER-CENTER TOGGLE CLAMP

DETAIL OF SINGLE OVER-CENTER TOGGLE CLAMP

PORTABLE AND DEMOUNTABLE LIFTING DEVICE

CROSS REFERENCE TO RELATED APPLICATIONS

This patent application is a continuation-in-part to commonly-owned U.S. patent application Ser. No. 09/790,920, entitled "Demountable Lifting Device" filed on Feb. 22, 2001 now U.S. Pat. No. 6,390,450.

TECHNICAL FIELD

The present invention relates generally to the field of portable lifting devices and, more particularly, to a demountable lifting device with a wide variety of selectable configurations.

BACKGROUND OF THE INVENTION

As the number of packages carried between locations increases, the need for more effective lifting devices increases. In most cases, robust deliverymen move heavy objects by physically lifting them from a storage location and placing them on a conventional transport device, such as a dolly or hand truck. For example, a delivery person might lift an object, such as a computer or printer, from a delivery truck and use a dolly to transport the object inside an office. Once inside the office, the delivery person again physically lifts the object and installs it in the desired location. Although many objects and can be physically manipulated in the manner, this technique has its limits, and can lead to serious consequences. For example, the availability of candidates to fill the delivery person job may be limited in instances in which only significantly robust individuals have the requisite strength to physically move the objects to be delivered. In some cases, this might require two delivery persons to deliver an object, when one delivery person with a more effective lifting device might be able to do the job. And even for strapping individuals, repetitive unaided lifting can result in injuries. In this long run, these injuries increase employment and insurance costs.

Mechanical lifting devices have been developed to assist in lifting certain types of objects. However, many of these devices are specialized for lifting only certain types of object and, as a result, do not provide a versatile or universal solution. Even lifting devices intended for general use typically do not adjust to accommodate objects of widely varying dimensions. In addition, many conventional lifting devices are not designed to facilitate portability, which further impedes their usefulness for certain applications. For example, many trucks are equipped with hydraulic lifts, but the lift cannot be removed for use in areas where the truck cannot travel. Many delivery trucks also carry a conventional hand truck, which can be removed for on-site use. But the hand truck does not include a power-assisted lifting device. In addition, portable power-assisted lifting devices have been developed, but these devices typically lack adjustments for enhancing portability or accommodating objects of widely varying dimensions.

Thus, there is a need for portable lifting devices with adjustments for enhancing portability or accommodating objects of widely varying dimensions.

SUMMARY OF THE INVENTION

The present invention meets the needs described above in a portable, power-assisted lifting device that can be quickly and easily taken apart and reassembled. In particular, the lifting device includes a mast constructed from two or more separable sections and a lifting belt, which can be any suitable type of flexible connector, such as a strap, chain, cable or other suitable connector, that can be supported by, or removed from, the mast. For example, the lifting belt typically extends over the top of the mast, and can be removed from this position to allow the mast to be easily taken apart. This allows the length of the mast to be adjusted to accommodate objects of widely varying dimensions.

The lifting device may include a removable carriage, which can be driven up and down the mast by the lifting belt. The lifting device may also include a drive mechanism for moving the carriage up and the mast, by reeling the lifting belt in or out. For example, the drive mechanism may be a crank driven by hand. Alternatively, the crank may be driven by a motor, such as a battery-powered electric drill or other suitable device. In addition, the gear box for the belt reel may include a fitting that may alternatively receive the hand crank or the battery-powered electric drill.

The removable carriage may carry various types of selectively removable end effectors to accommodate lifting different types of objects. For example, certain end effectors may be fixed, while others may be adjustable. In some cases, the end effectors may be driven (e.g., opened, closed, rotated, etc.) by a hand or motorized device, such as the same device that drives the carriage up and down the mast. Different types of removable carriages may also be deployed.

The ability to easily take apart and reassemble the lifting device, which is referred to as "demountability," enables efficient storage when the device is not in use. For example, the disassembled lifting device could be stored in a rack mounted on a delivery truck or equipment bay. The storage rack may include an electric cradle to charge the battery in the battery-powered electric lift and propulsion motors while the lifting device is in storage. From this storage position, many different configurations of the lifting device may be quickly assembled for many different applications.

Generally described, the invention is a lifting device that includes a mast separable into a plurality of sections and a pulley supported by a first section of the mast. A dolly that supports the mast includes one or more transport structures for movably supporting the lifting device. An actuator is mounted on a second section of the mast. A carriage captured on the mast is configured to slide along the mast and directly or indirectly support an object to be lifted. The invention also includes a belt with a first end and a second end. The first end attaches to the carriage and the second end attaches to the actuator so that the belt extends over the pulley. The actuator selectively reels the belt in and out when the belt is positioned over the pulley. This causes the carriage to move up and down along the mast. Because the belt is removable from the pulley, the first section of the mast may be removed from the second section of the mast when the belt is removed from the pulley. This provides the lift with demountable portability.

More specifically described, the dolly could include a first leg assembly and a second leg assembly that extend from the dolly. These assemblies support the lifting device and enhance mobility. Alternatively, the carriage could include at least two end effectors that directly support the object to be lifted. The actuator could also include a crank or a motor.

In view of the foregoing, it will be appreciated that the lifting device of the present invention avoids the drawbacks of prior systems. The specific techniques and structures employed by the invention to improve over the drawbacks of the prior systems and accomplish the advantages described above will become apparent from the following detailed description of the embodiments of the invention and the appended drawings and claims.

DETAILED DESCRIPTION OF THE EMBODIMENTS

Figure 1:
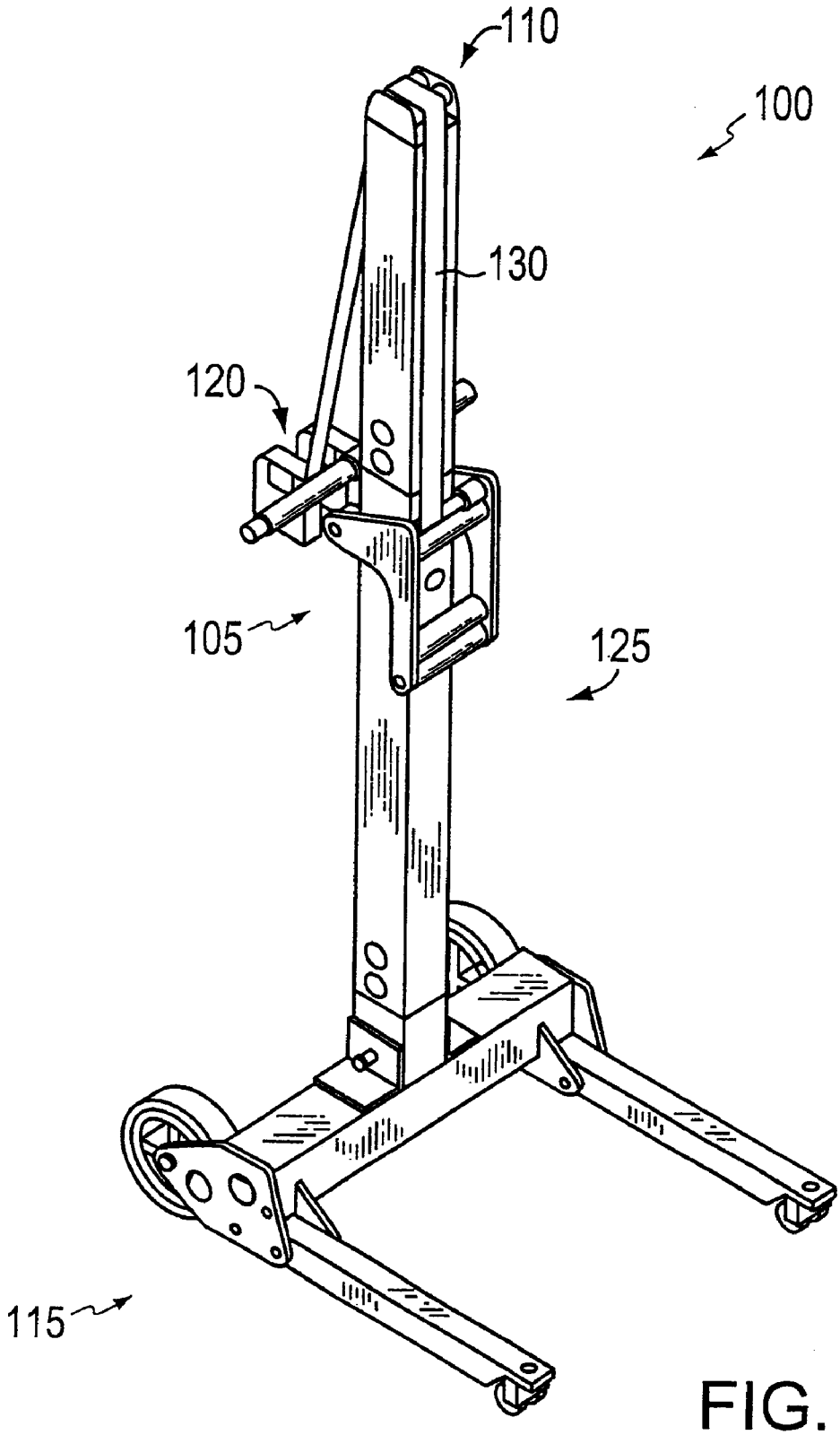
FIG. 1 is a perspective view of a demountable lifting device according to the present invention.

The present invention may be embodied in a demountable lifting device configured for enhance portability and lifting a variety of objects. FIG. 1 is a perspective view of a demountable lifting device 100 according to the present invention. This lifting device primarily includes a mast 105, a pulley 110, a dolly 115, an actuator 120, a carriage 125, and a belt 130. This belt 130 may be any suitable type of flexible connector, such as a strap, chain, cable or other suitable connector. The belt 130 may be directly or indirectly coupled to the carriage 125 so long a the carriage may be moved up and down along the mast through operation of the actuator 120 on the belt. Portions of the mast 105, pulley 110, dolly 115, actuator 120, and carriage 125 could be made from aluminum or other suitable material, such as fiberglass, or a composite. The belt 130 is typically canvas, but may be alternatively constructed from Kevlar or some other suitable material.

Figure 2:
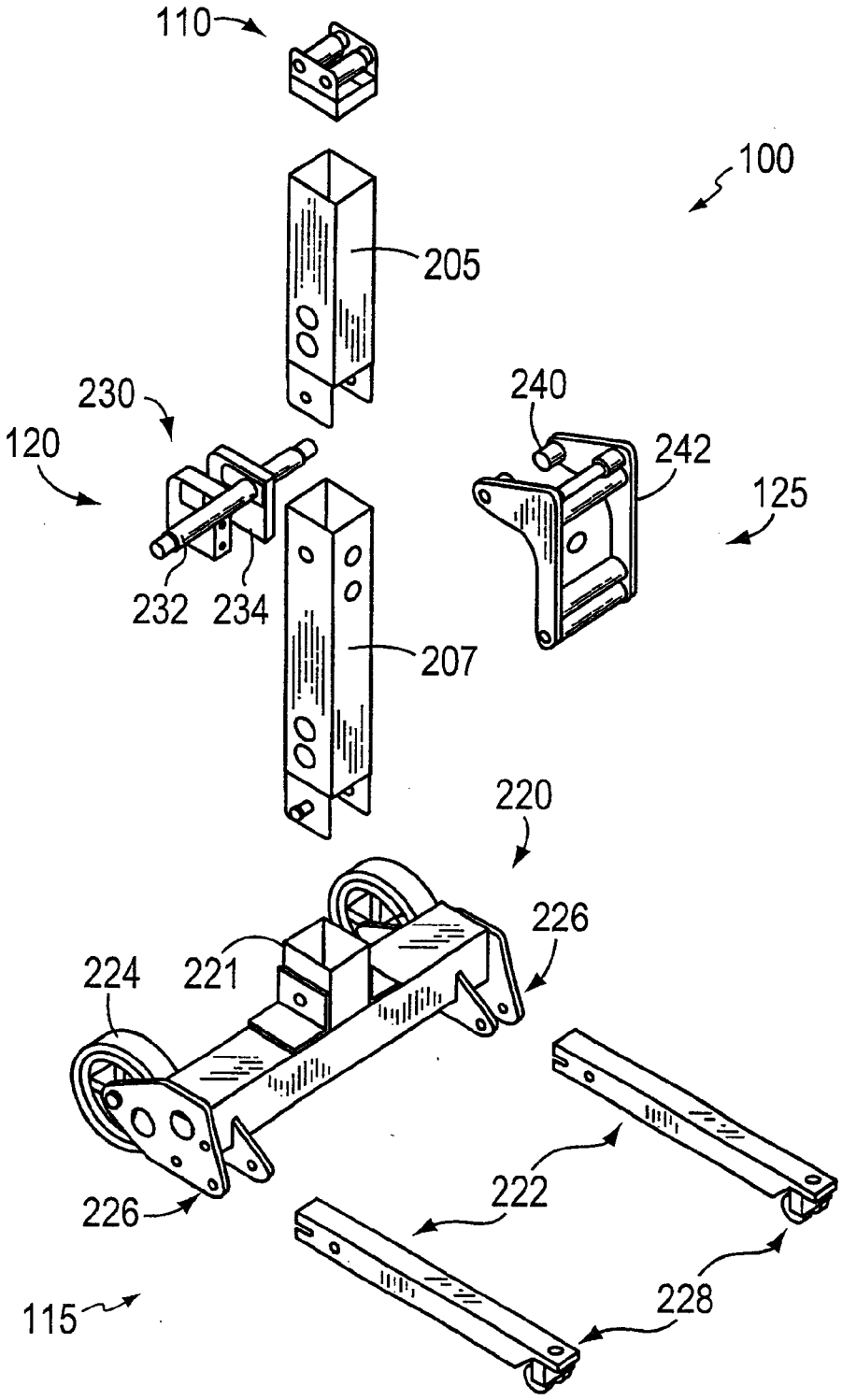
FIG. 2 is an exploded view of the lifting device of FIG. 1 illustrating the separability of some components.

FIG. 2 is an exploded view of the lifting device 100 illustrating the separability of the major components. The mast 105 generally forms the frame of the lifting device 100 and is separable into a top section 205 and a bottom section 207. A fastener, such as a locking pin, can secure these sections to each other. While this mast is separable into two sections, the lifting device 100 could include a mast separable into three, four or more sections. The separability of the mast 105 creates substantial advantages over conventional devices including adjustability of the length of this mast. During storage of the lifting device 100, mast sections of varying length could be mounted to the inside of a delivery truck, for example. A deliveryman may select the sections of the mast that enable effective lifting of a particular object. For example, a deliveryman may select two long sections of the mast 105 to lift a box with a height of five feet.

In addition to the mast 105, the lifting device 100 includes the modular pulley 110 supported by a section of the mast 105. For example, the top section 205 of this mast can support the pulley 110. Alternatively, the pulley 110 and the top section 205 may form a unitary structure. If the pulley 110 is modular and removable, it can be used with either the top section 205 or the bottom section 207 of the mast 105. For example, the pulley 110 could connect to a top end of the bottom section 207, which results in a shorter mast. Consequently, the modular pulley 110 remains operative despite length changes of the mast 105.

The dolly 115 supports the mast 105 and enables movement of the lifting device 100. This dolly 115 includes a base assembly 220 and leg assemblies 222. The base 220 includes a connector 221 that receives and secures the bottom section 207 to the dolly 115. The base 220 can include transport structures, such as wheels 224 that enhance portability. Alternatively, the transport structures could include conveyors that slide the lifting device 100 to different locations. In addition, the base 220 includes a connector 226 that enables securing of the leg assemblies 222. A fastener, such as a locking pin, can secure the leg assemblies 222 to the base 220. Other suitable fasteners can also be used, such as a bolt, clamp, or clasp. The leg assemblies 222 also include transport structures 228 that enhance mobility of the lifting device 100. These transport structures could be casters or some other pivotable device that enables better steering of the lifting device 100. Consequently, the dolly 115 enables easy movement of the lifting device 100.

The actuator 120, carriage 125 and belt 130 jointly enable lifting of an object by the lifting device 100. The actuator 120 includes a gearbox 230 and a handle 232 attached to the bottom section 207 of the mast 105. Alternatively, the actuator could be attached to another section of the mast or removable. A brace 234 supports the gearbox 230 and the handle 232. When activated, the actuator 120 selectively reels the belt 130 in and out using the gearbox 230. The handle 232 enables steering of the lifting device 100. In an alternative embodiment, this handle could be powered, for example by a battery-powered drill.

The carriage 125 slides along the mast 105 and can support an object either directly or indirectly. This carriage preferably slides along the top section 205 and the bottom section 207 of the mast 105. Rollers 240 enhance the movement of this carriage. The carriage 125 can connect to the mast 105 by sliding over a mast section. Alternatively, this carriage 125 could remain mounted to a section of the mast. For example, the carriage 125 could slide toward the dolly 115 during demounting of the lifting device 100. The carriage 125 also includes removable end effectors described with reference to FIG. 3 that extend from this carriage and directly support an object. Fasteners, such as a screw, locking pin, clasp or other suitable device can secure these end effectors to this carriage.

The belt 130 connects the actuator 120 to the carriage 125 and extends over the pulley 110 as illustrated in FIG. 1. A hook at the end of the belt 130 secures it to a rod 242 in this carriage. Because the belt 130 is attached to the actuator 120, securing this belt to the carriage 125 places it in mechanical communication with the actuator 120. As the actuator 120 reels the belt 130 in and out, the carriage 125 slides along the mast 105. The belt 130 can be removed from the pulley 110 and enable demounting of the lifting device 100. For example, a deliveryman can remove the belt 130 from the pulley 110 and remove the slack from this belt during the disassembly of the lifting device 100.

Figure 3:
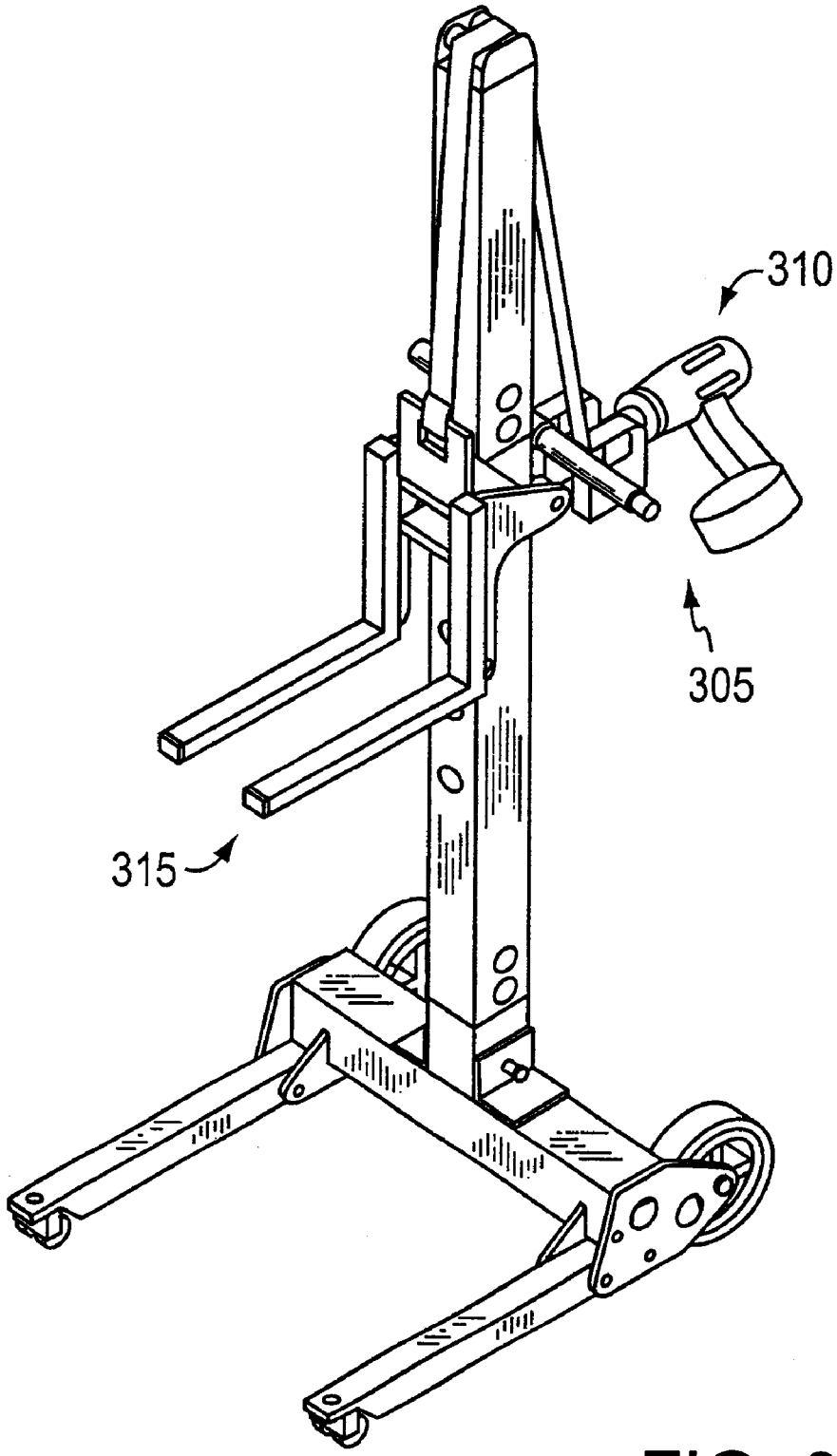
FIG. 3 is a perspective view of the lifting device of FIG. 1 illustrating a motorized actuator.

FIG. 3 is a perspective view of the lifting device 100 illustrating a motorized actuator. The actuator 305 includes a motor 310 that drives the gearbox 240. This motor could be a battery powered motor, small electric motor, or other suitable motor. When the motor 310 is powered, it causes the belt 130 to reel in or out. This action moves the end effectors 315, which directly support the object to be lifted. To accommodate objects of varying width, the spacing between these end effectors could be adjusted. In addition, the end effectors 315 could be shaped like a box and partially surround the object to be lifted.

Figure 4:
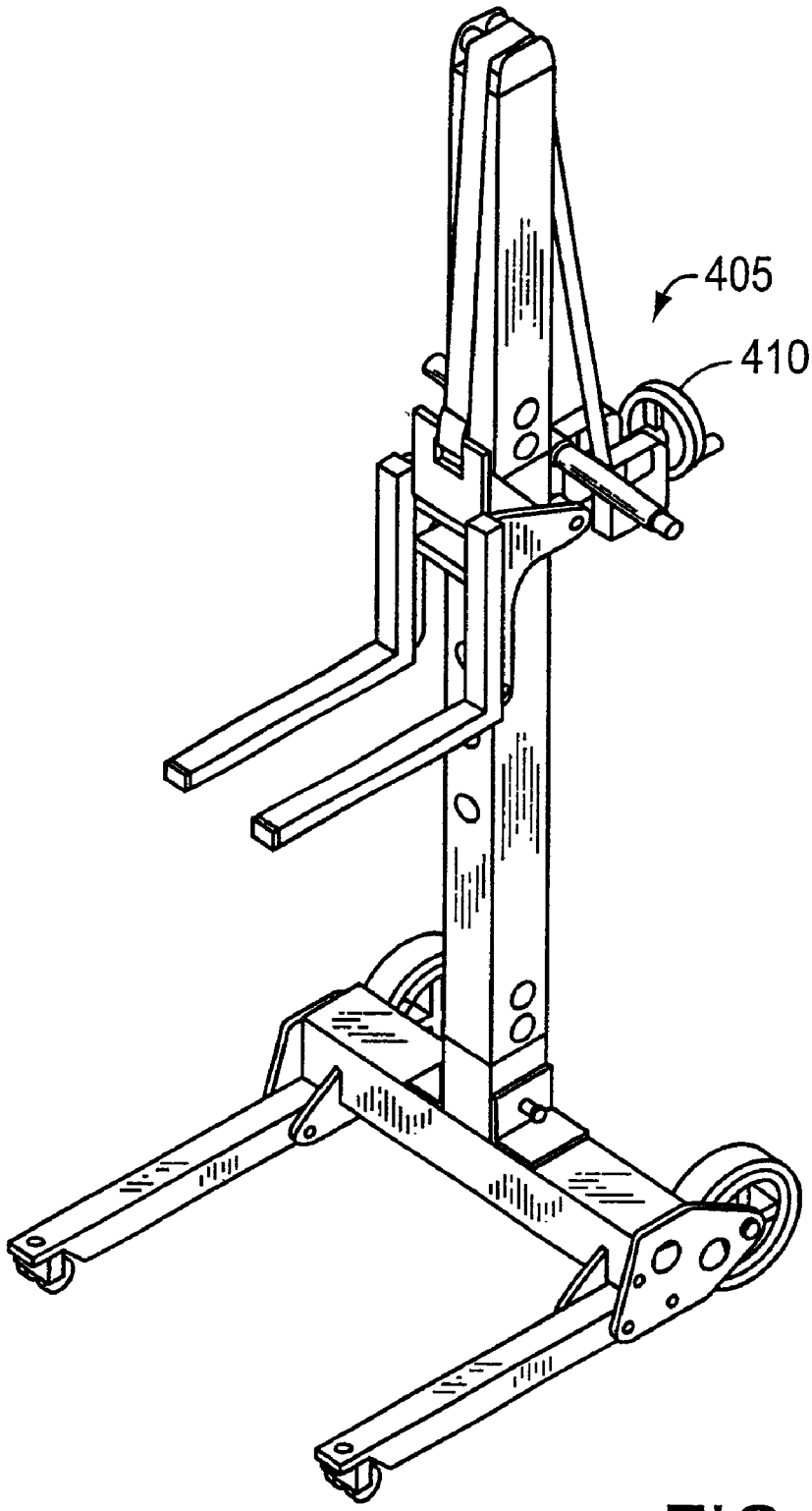
FIG. 4 is a perspective view of the lifting device of FIG. 1 illustrating a manually driven actuator.

FIG. 4 is a perspective view of the lifting device 100 illustrating a manually driven actuator. The actuator 405 includes a wheel 410 that drives the gearbox 230. Turning this wheel reels the belt 130 in and out. Alternatively, the actuator 405 could include another type of crank, such as a roller, or some other suitable device.

Figure 5:
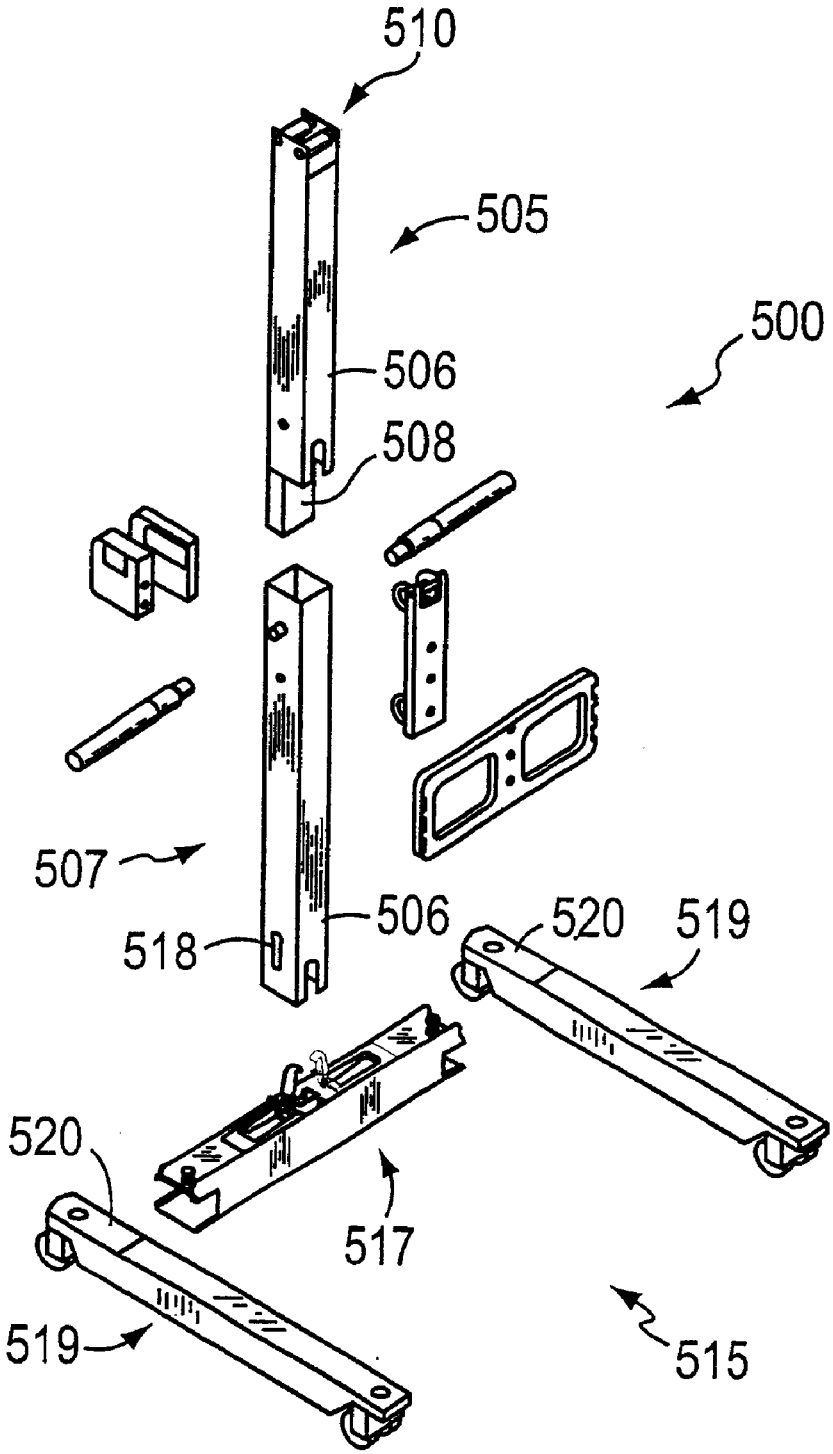
FIG. 5 is an exploded view of an alternative embodiment of the lifting device of FIG. 1.

Turning to FIG. 5, it is a perspective view of an alternative embodiment of the lifting device 100. The lifting device 500 includes a mast separable into a top section 505 and a bottom section 507. A bayonet 508 extends from the lower portion of the top section 505 into an aperture in the bottom section 507. This bayonet aids in assembling and aligning the sections of the mast. In an alternative embodiment, the lifting device 500 could include three, four, or more mast sections. As a result, several sections of the mast would include a bayonet. In addition, the top section 505 includes a pulley 510 securely attached to the top end of this section. Though the pulley 510 remains attached to the mast section 505, it functions similarly to the pulley 110 described in reference to FIG. 1.

Figure 6:
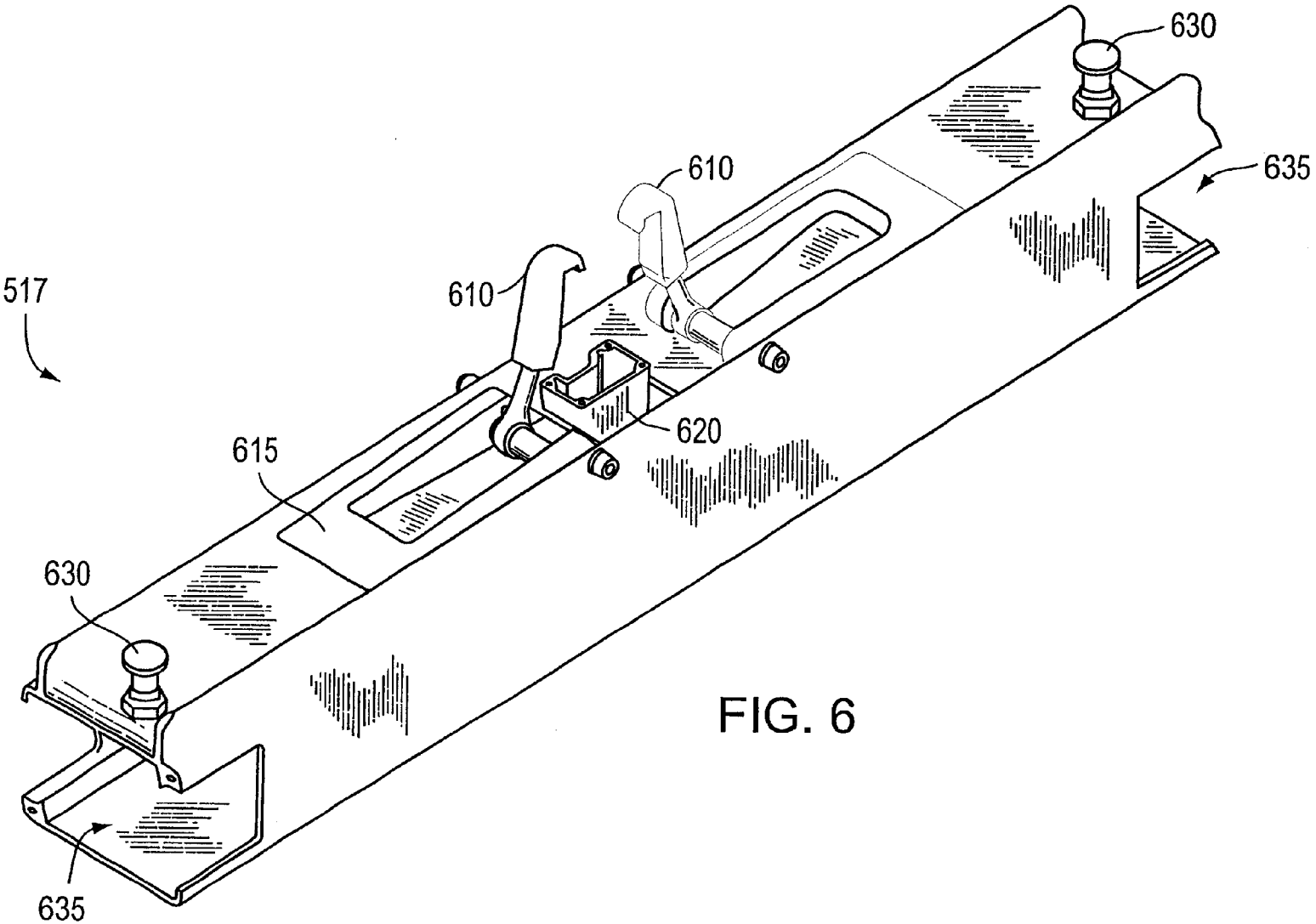
FIG. 6 is an enlarged perspective view of the base assembly FIG. 5 illustrating the components of the base assembly.

The lifting device 500 also includes a dolly 515 that aids in movement. The dolly 515 includes a base assembly 517 and leg assemblies 519. FIG. 6 is an enlarged perspective view of the base assembly 517 illustrating the components of the base assembly. This base assembly 517 includes latches 610 and a bayonet 620 that effectively secure and stabilize the bottom mast section 507. During assembly, moving this bottom mast section toward the base assembly 517 pivots the spring-biased latches 610 away from the bottom mast section 507. As best illustrated on FIG. 5, the bottom mast section 507 includes orifices 518 that can receive the latches 610. As these latches pivot, the bottom mast section 507 surrounds the bayonet 620 and stabilizes the lifting device 500. In response, the orifices 518 approach the latches and cause them to pivot into a locking position. The locking of these latches effectively secures the bottom mast section 507 to the base assembly 517.

The base assembly 517 also includes plunger pins 630 and receptacles 635 that attach it to the leg assemblies 519. Because these plunger pins are biased downward, moving the leg assemblies 519 toward the receptacles 635 contracts the plunger pins 630. As orifices in these leg assemblies align with the plunger pins 630, they lock and securely attach the base assembly 517 to the leg assemblies 619. To disassemble these leg assemblies, an operator can lift the plunger pins 630. Moreover to disassemble the base assembly 517 from the lower mast section 507, an operator can pivot the latch lift 615.

Figure 7:
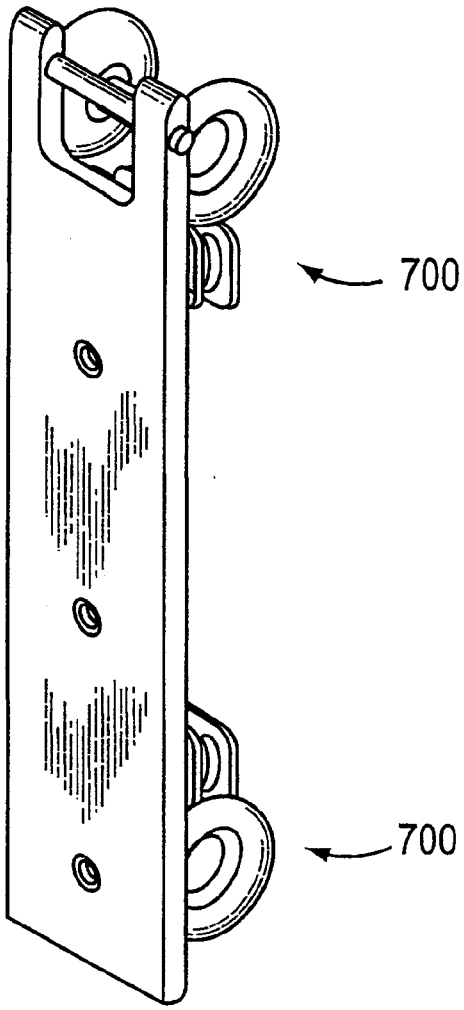
FIG. 7 is a perspective view of an internally riding carriage assembly for the lifting device of FIG. 5.
Figure 7:
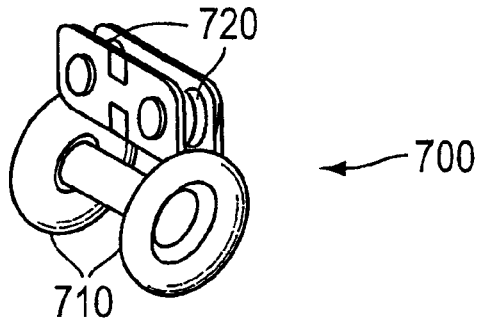

The lifting device 500 also includes a carriage for lifting an object. This carriage includes end effectors as described with reference to FIGS. 3–4, a carriage assembly 530 and carriage plate 540. The carriage assembly 530 moves within a groove 506 in the top mast section 505 and the bottom mast section 507. FIG. 7 is a perspective view of the carriage assembly 530 for the lifting device 500. This carriage assembly includes two sets 700 of transport structures that aid in movement. Within each transport structure set 700, the transport structures 710 aid in vertical movement of the carriage assembly 530. In addition, transport structures 720 positioned perpendicular to the transport structures 710 aid in minimizing the torque experienced by this carriage assembly during vertical displacement. For example, as an operator lifts an object by moving the carriage assembly upward, the transport structures 710 aid in movement. Transport structures 720 enable more even lifting, which reduces likelihood of dropping, by minimizing torque. The transport structures 710 and transport structures 720 could be rollers. However, the transport structures 720 could have a smaller diameter than the transport structures 710.

The lifting device 100 according to the present invention effectively lifts a variety of objects and enhances portability. The separability of major components aids in efficient storage after demounting the lifting device 100. For example, the mast 105, pulley 110, dolly 115, carriage 125, and belt 130 can be removable. Disassembling these components enables storing this device in a space-restricted area. In addition, demounting the lifting device 100 enables adjusting it to accommodate objects of varying size. The modular pulley 110 can attach to each section of the mast 105. Hence, this pulley remains operational as the mast length varies. Reducing or extending the length of this mast enables lifting objects of varying height. This adaptability provides a universality that minimizes the number of lifting devices need. Varying the type and space of the end effectors 315 enables grasping objects with odd shapes. The lifting device 100 also enhances portability by including several transport structures that improve steering and mobility. In addition, this device can also be used with battery-powered devices that provide balanced lifting. Together, these features distinguish the lifting device 100 from conventional devices.

It should be understood that the lifting device 100 may be modified in a wide variety of ways to meet different service and storage objectives. In addition, the individual components of the left may be implemented with any of a wide variety of available materials. For example, the belt 130 may be any suitable type of flexible connector, such as a strap, chain, cable or other flexible material. The belt 130 may be connected to the crank 120 directly or indirectly through one or more intervening element, such as a latch or connecting link. Similarly, the belt 130 may be connected to the carriage 125 directly or indirectly through one or more intervening element. For example, the belt 130 may be connected to a fork lift or other type of end effector that is carried by the carriage 125. The mast 105 may be demountable in to any number of mast sections, typically two or three, and a wide range of connectors may be deployed for selectively connecting the mast sections together. A similar range of connectors may likewise be used to connect the mast 105 to the dolly 115, and for assembling the components of the dolly. In practice, it has been observed that certain design configurations and options are desirable under certain circumstances. These particular configurations and options are described below.

Figure 8:
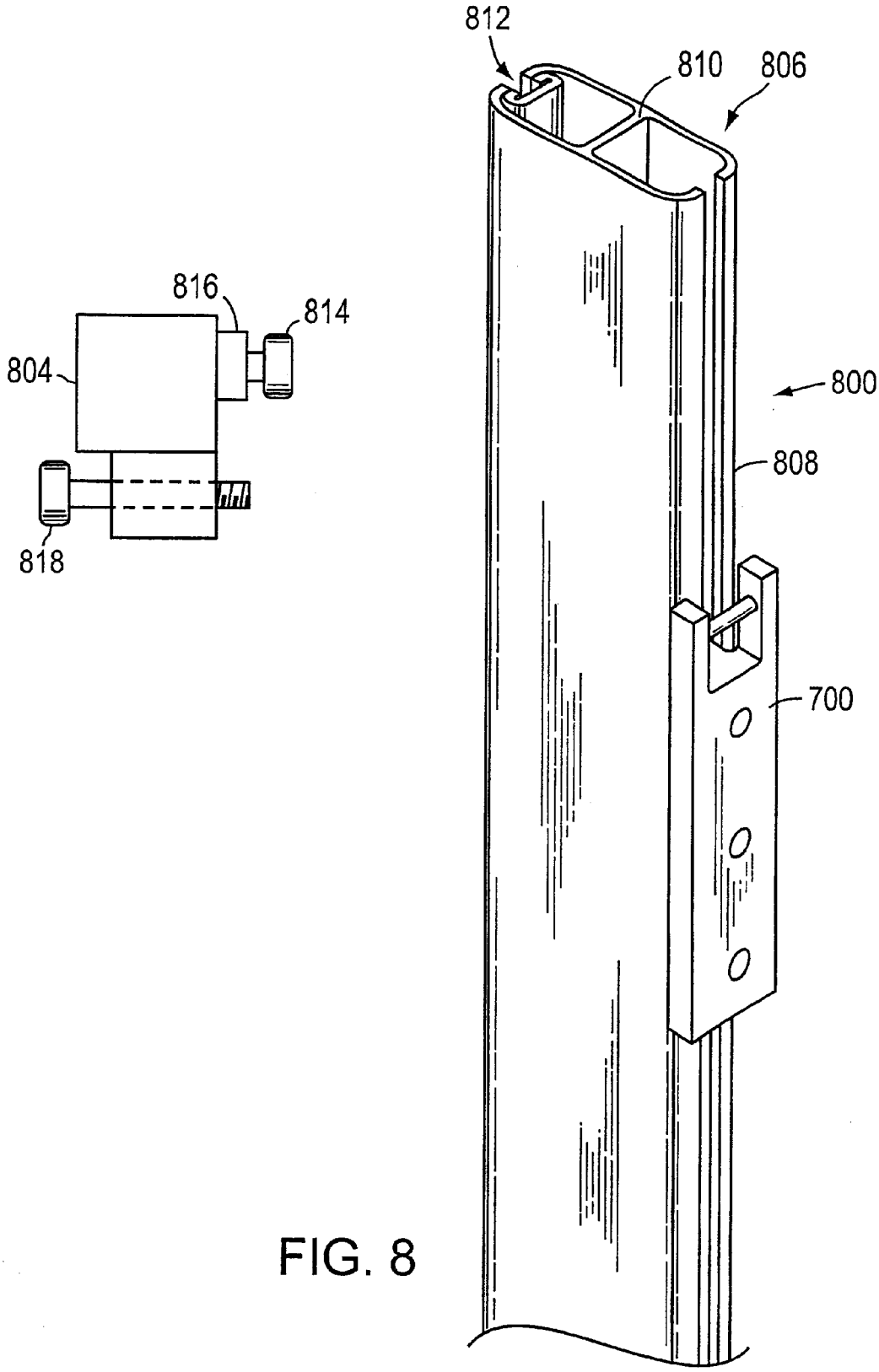
FIG. 8 is a perspective view of a mast assembly for a lifting device with an internally riding carriage and removable crank assembly.

FIG. 7A is a perspective view of an internally riding carriage assembly 530, which is configured to ride on the mast 800 with its wheels 702 and 704 riding within a channel 806 defined within the mast, as shown in FIG. 8. FIG. 7B is a perspective view of a wheel assembly 700 for the internally riding carriage 530. FIG. 7C is a perspective view of an internally riding carriage assembly 530' including stabilizer wheels 712. FIG. 7D is a side view of the internally riding carriage assembly 530'.

FIG. 8 is a perspective view of a mast 800 for a lifting device with an internally riding carriage 530 or 530' and removable crank assembly 804. The internally riding carriage 530 or 530, which is shown in FIGS. 7A–D, includes two sets of wheels 702 and 704 that ride in a first channel 806 formed into the mast 800. Due to the effect of gravity on the carriage 802, the upper set of wheels 720 ride along the inside surface of the front wall 808 of the first channel 806, whereas the lower set of wheels 704 ride along the inside surface of the real wall 810 of the first channel 806. The carriage 700 may also include stabalizer wheels 712 for riding along inside surfaces of the side walls of the channel 806, as shown in FIGS. 7C and 7D, to prevent binding of the carriage in the channel 806. The carriage 530 or 530 should roll freely within the mast 800, and my be removed from the mast by sliding the carriage out the end of the first channel 806 defined in the mast.

Figure 9B:
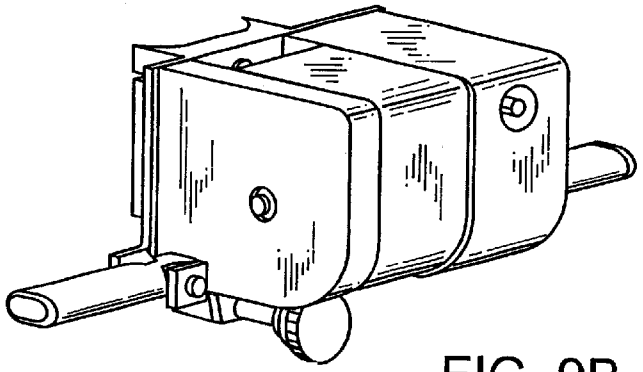
FIG. 9B is a perspective view of a removable crank assembly for a lifting device.
Figure 9D:
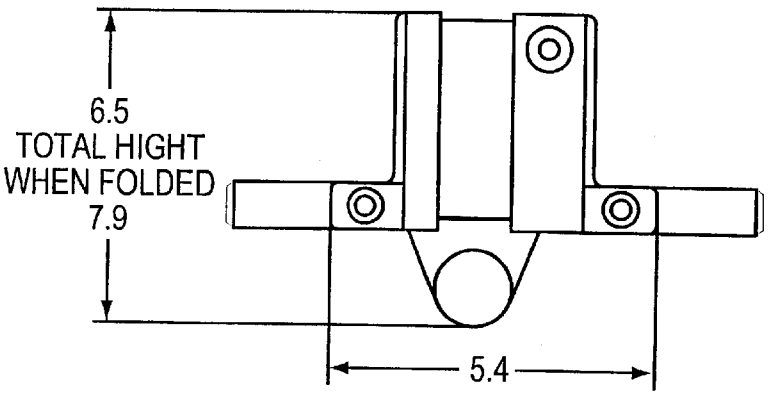
FIG. 9D is a front view of a removable crank assembly for a lifting device.
Figure 9A:
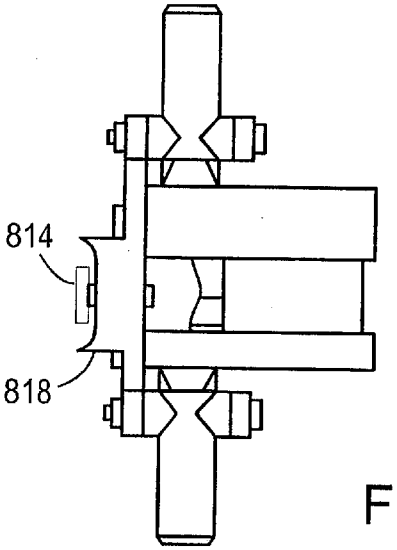
FIG. 9 A is a top view of a removable crank assembly for a lifting device.
FIG. 9C is a side view of a removable crank assembly for a lifting device.
Figure 9C:
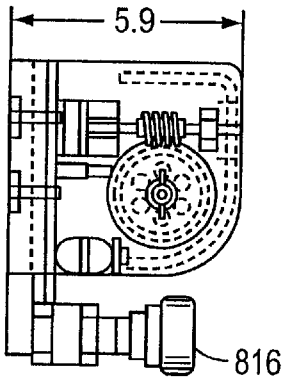

The second channel 812 formed into the mast 800 is configured to removably receive the crank assembly 804. The crank assembly includes a pin 814 configured to be slidably received within the second channel 812. The pin is located within a form-fitting bracket 816 that is shaped to correspond to the outer profile of the mast 800 when the crank 804 is received within the channel 812. Once the crank assembly 804 is moved into a desired location along the mast, a threaded stop 816 may be turned to lock the crank assembly 804 in place. The second channel 812 may include threaded holes or other suitable receptacles along its length for receiving the threaded stop 818 for added connection strength. In particular, receptacles may be located at one or more convenient locations along the mast 800. FIG. 9 A is a top view of a preferred removable crank assembly 804 showing the pin 814, bracket 816 and threaded stop 818. FIG. 9B is a perspective view of the preferred removable crank assembly., and FIG. 9C is a side view of the preferred removable crank assembly. FIG. 9D is a front view of a the preferred removable crank assembly.

Figure 10:
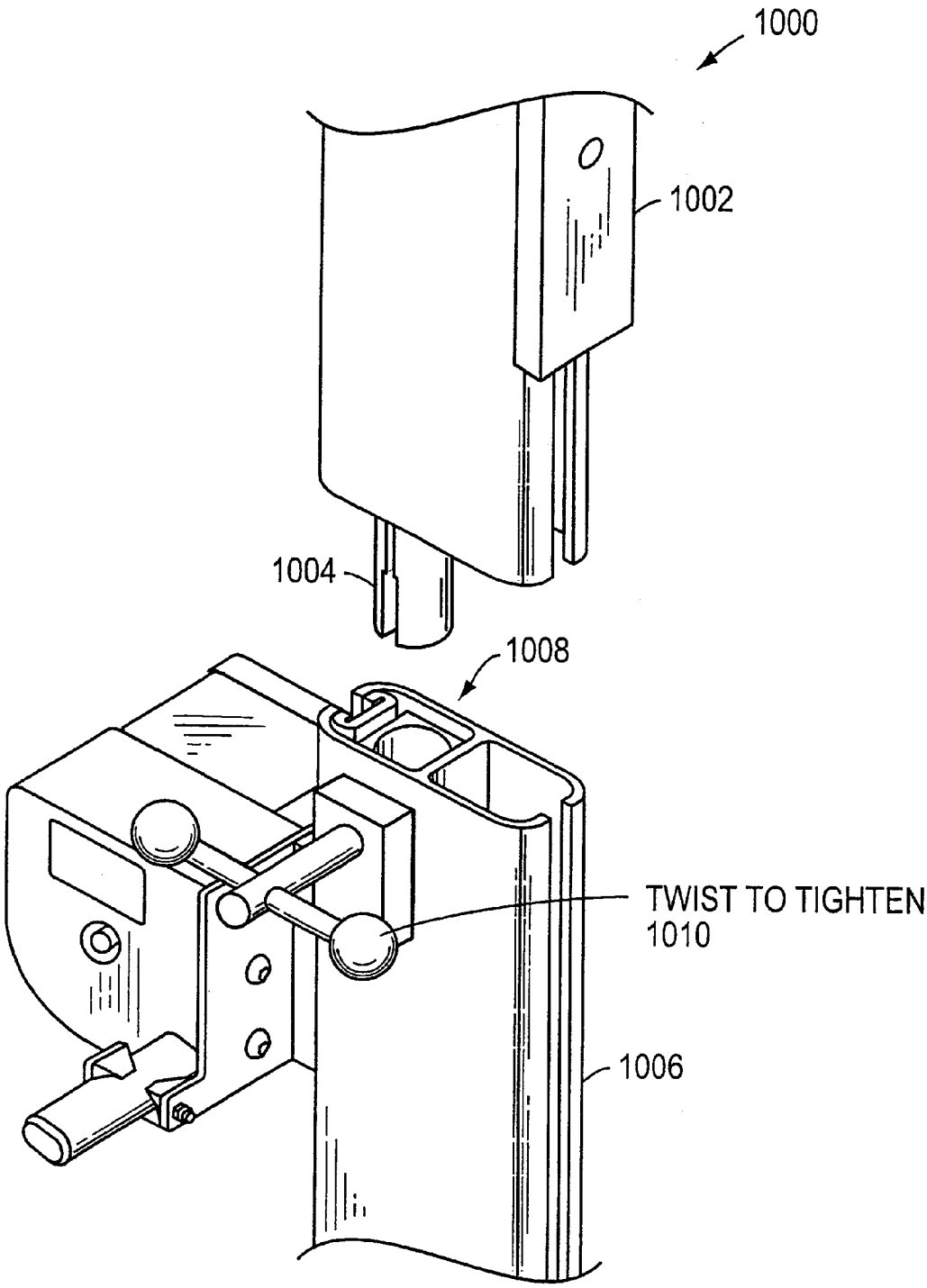
FIG. 10 is a perspective view of a mast assembly connection for a lifting device.
Figure 11:
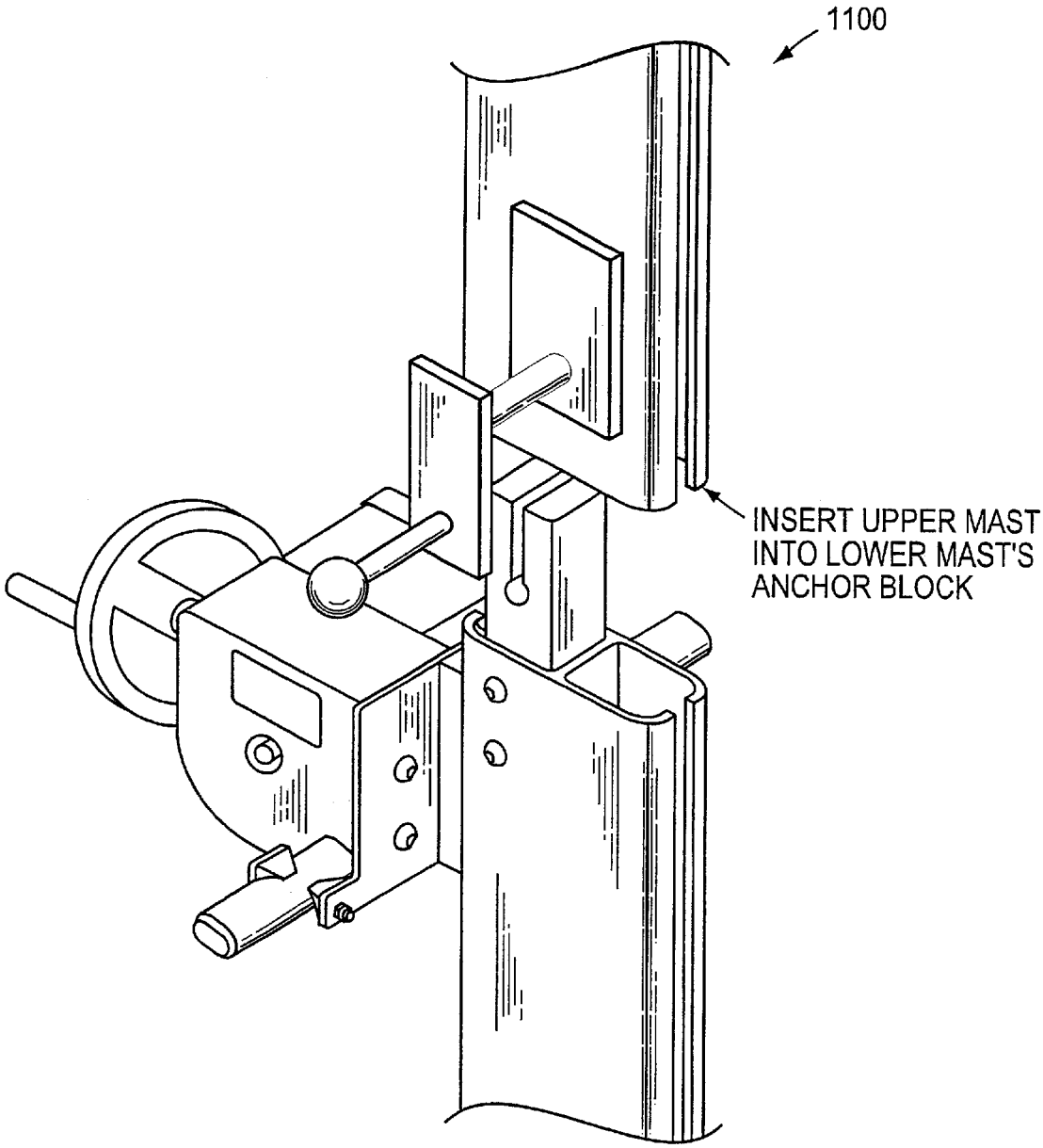
FIG. 11 is a perspective view of an alternative mast assembly connection for a lifting device.

FIG. 10 is a perspective view of a mast assembly connection 1000 for the lifting device 100 including a post-and-channel joint. The mast assembly connection 1000 includes a first mast section 1002 defining a post 1004. A second mast section 1006 includes a channel 1008. configured to snugly receive the post 1004. The post 1004 also includes a receptacle, such as a threaded hole, for receiving a stop when the post 1004 is located within the channel 1008. In particular, a threaded stop 1010 on the second mast section 1006 is positioned so that it may be turned stop when the post is located within the channel 1008 to enter the stop into the receptacle in the post. FIG. 11 is a perspective view of an alternative post-and-channel mast assembly connection 1100 with a larger post configured to provide a stronger mast-to-mast connection.

Figure 12:
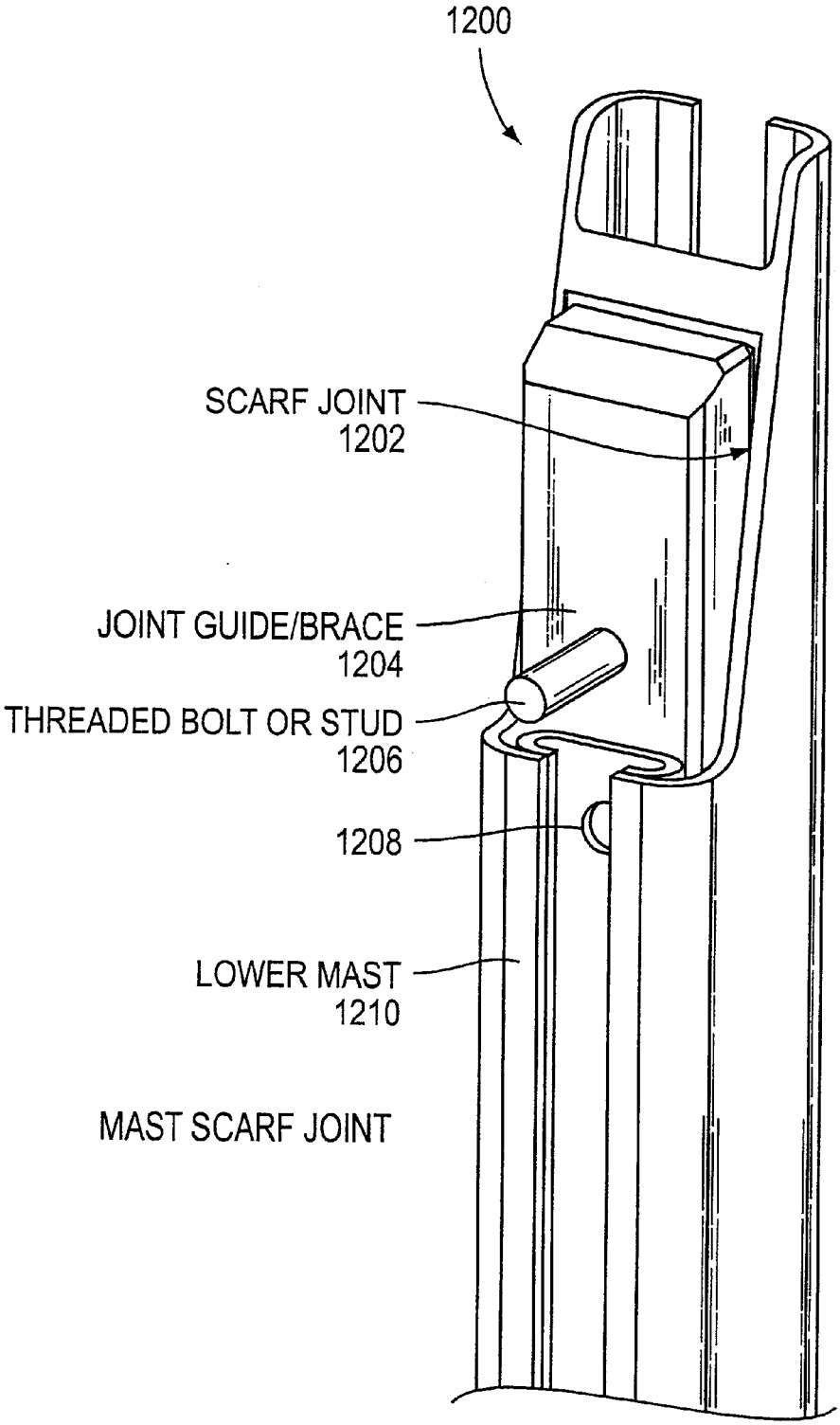
FIG. 12 is a perspective view of a second alternative mast assembly connection for a lifting device before the mast sections have been connected.
Figure 13:
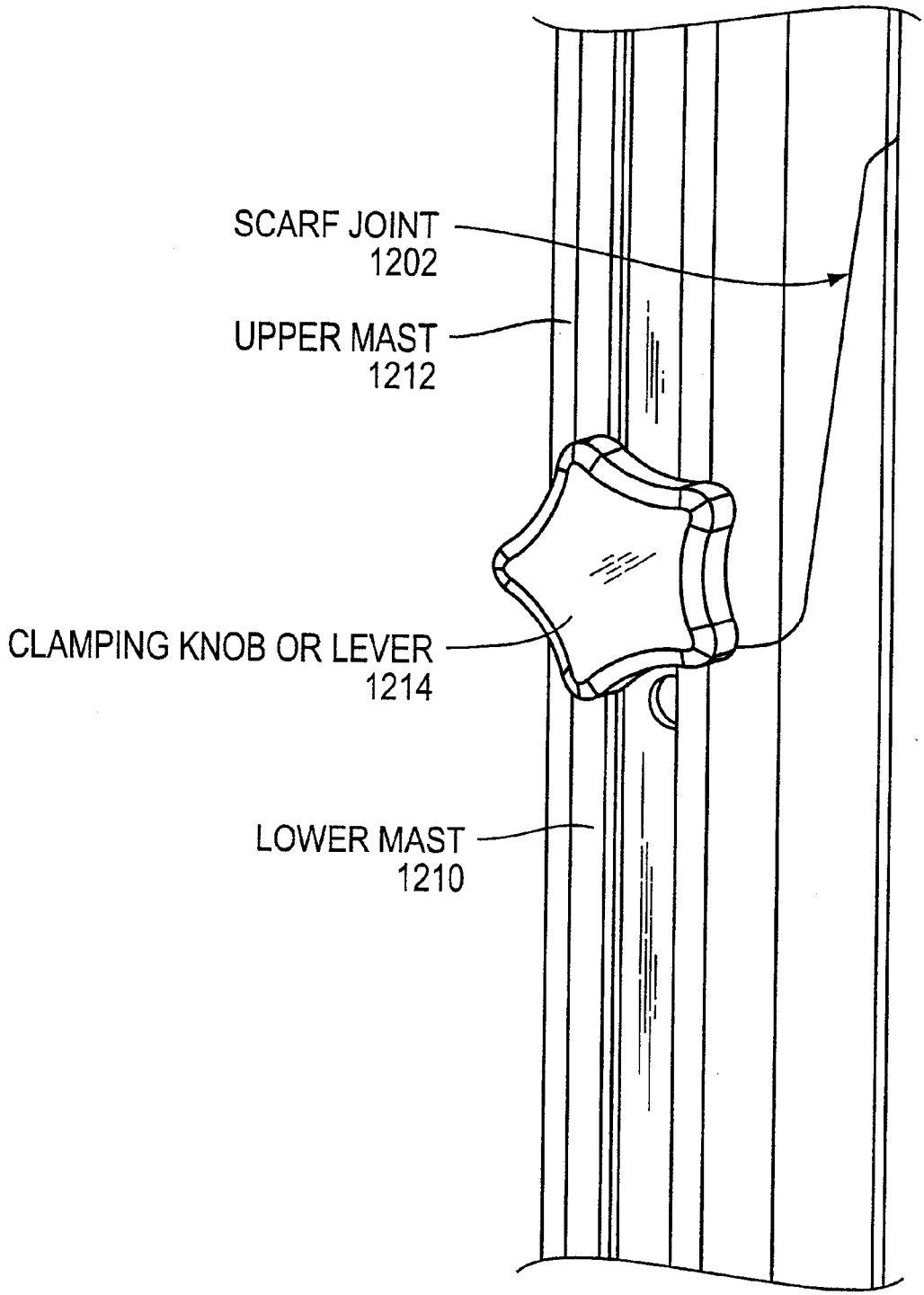
FIG. 13 is a perspective view of a second alternative mast assembly connection for a lifting device after the mast sections have been connected.

FIG. 12 is a perspective view of a second alternative mast assembly connection 1200 for the lifting device before the mast sections have been connected. This mast-to-mast connection includes a scarf joint 1200 that provides enhanced joint strength. The scarf joint surrounds a joint guide brace 1204 that is typically bolted or welded to a first mast section 1210. The joint guide brace 1204 supports a threaded bolt or stud 1206 for connecting a second mast section 1212 to the scarf joint. In particular, FIG. 13 is a perspective view of the second alternative mast assembly connection 1200 after the second mast section 1212 has been connected. A clamping knob or lever 1214 may be screwed onto the threaded bolt or stud 1206 to secure the scarf joint connection.

Figure 14:
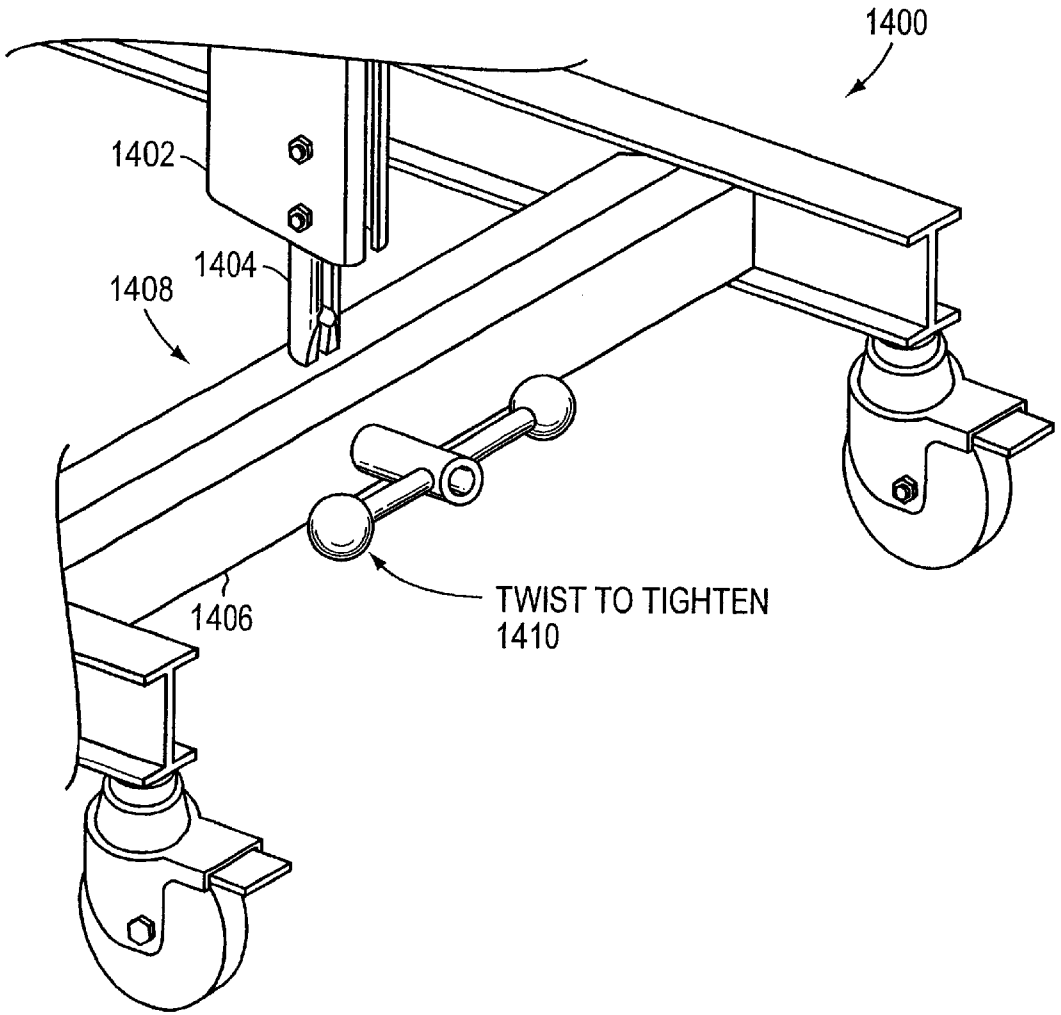
FIG. 14 is a perspective view of a mast-to-base connection for a lifting device.

FIG. 14 is a perspective view of a mast-to-base connection 1400 for the lifting device 100 including a post-and-channel joint. The mast assembly connection 1000 includes a mast 1402 carrying a post 1404 on the bottom of the mast. A base (typically a dolly) 1406 includes a channel 1408 configured to snugly receive the post 1404. The post 1404 also includes a receptacle, such as a threaded hole, for receiving a stop when the post is located within the channel 1408. In particular, a threaded stop 1410 on the base 1406 is positioned so that it may be turned stop when the post 1404 is located within the channel 1408 to enter the stop into the receptacle in the post.

Figure 15:
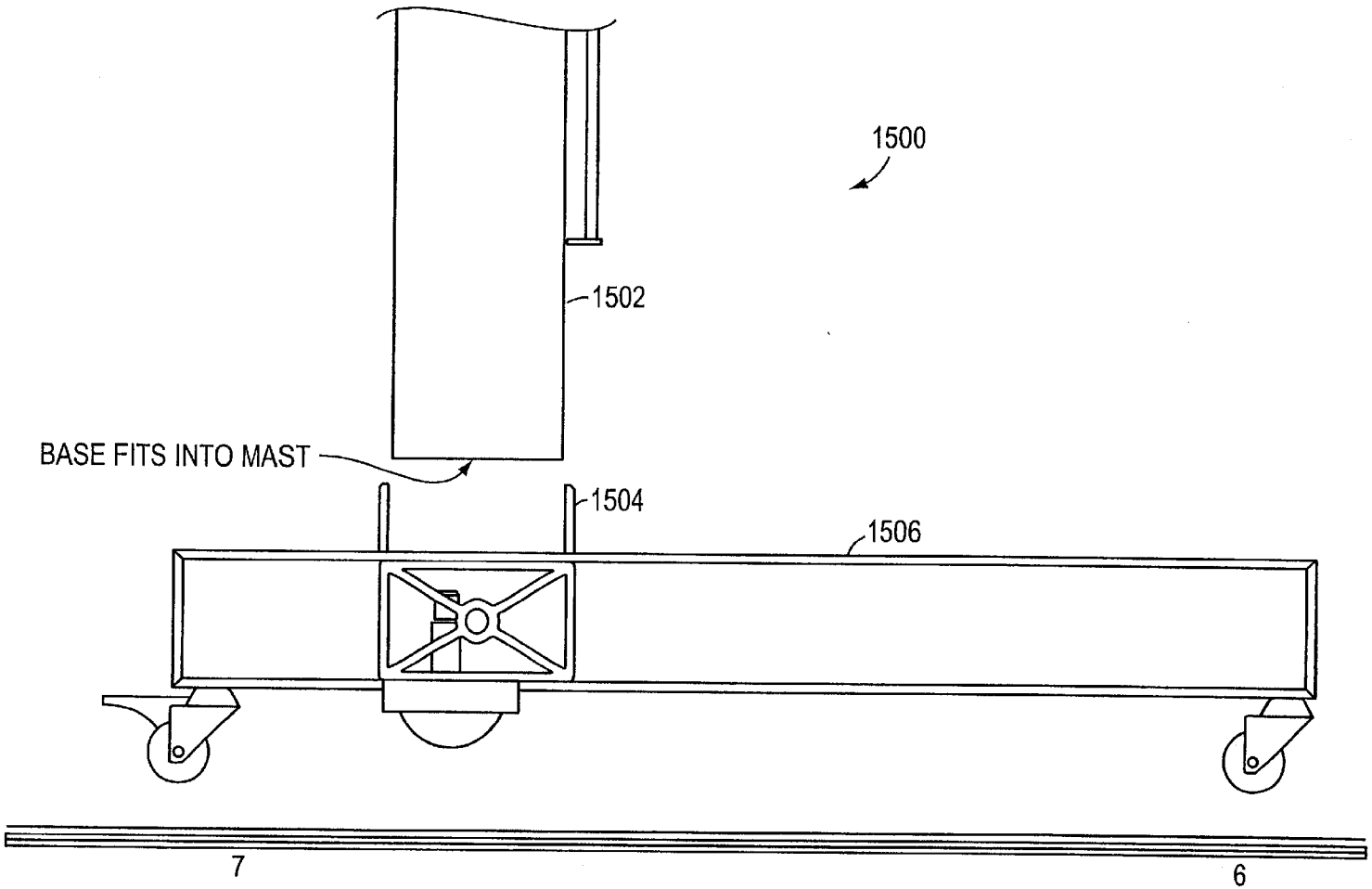
FIG. 15 is a side view of an alternative mast-to-base connection for a lifting device before the mast has been connected to the base.
Figure 16:
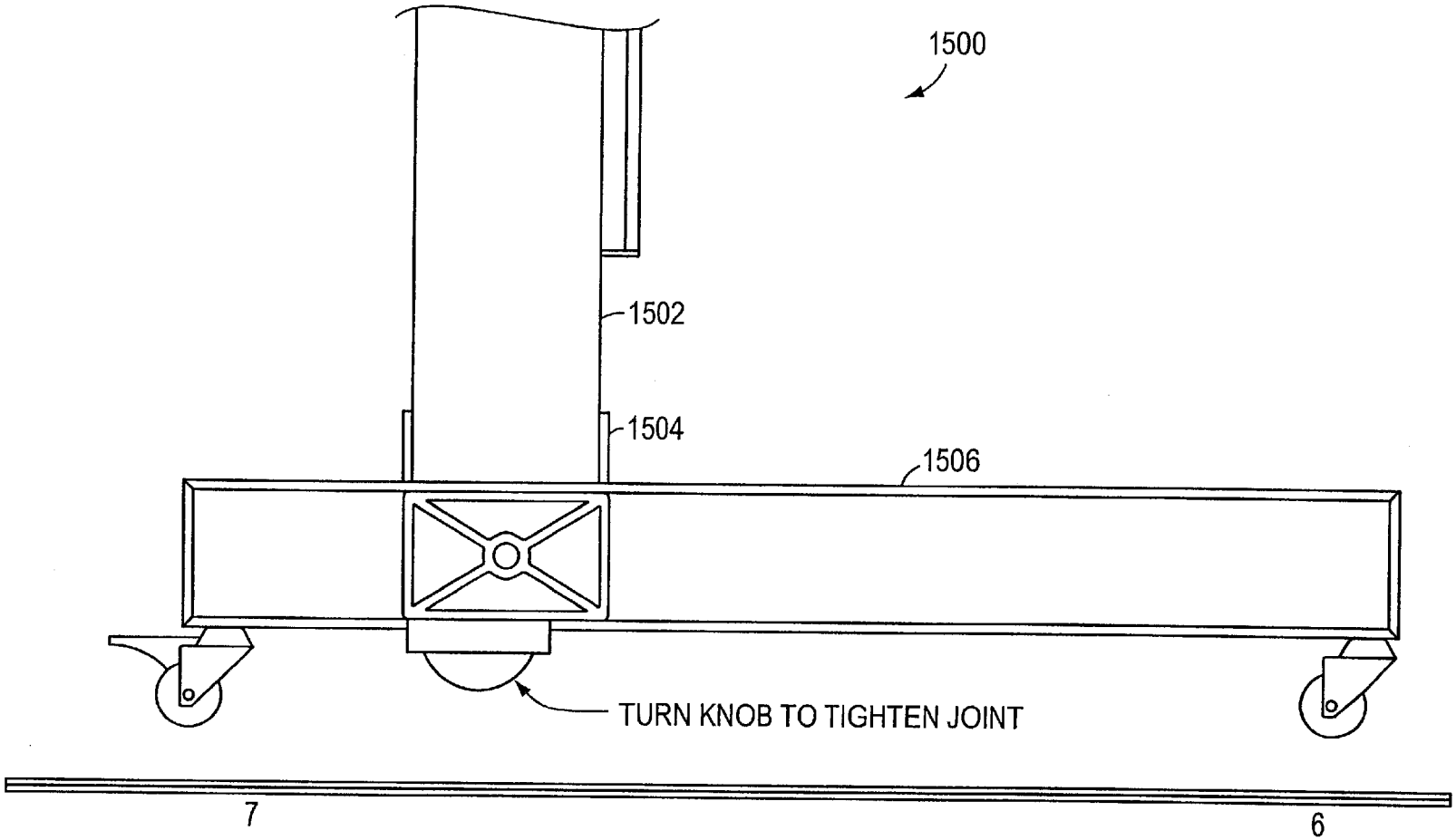
FIG. 16 is a side view of an alternative mast-to-base connection for a lifting device after the mast has been connected to the base.

FIG. 15 is a side view of an alternative post-and-channel connection 1500 for the lifting device 100. In this embodiment, the mast 1502 is received within a collar 1504 carried by the base 1506. FIG. 15 shows the connection 1500 before the mast has been connected to the base, and FIG. 16 shows the connection 1500 after the mast has been connected to the base. Typically, a pin or threaded stop may be used to secure the mast 1502 within the collar 1504 when desired.

Figure 17:
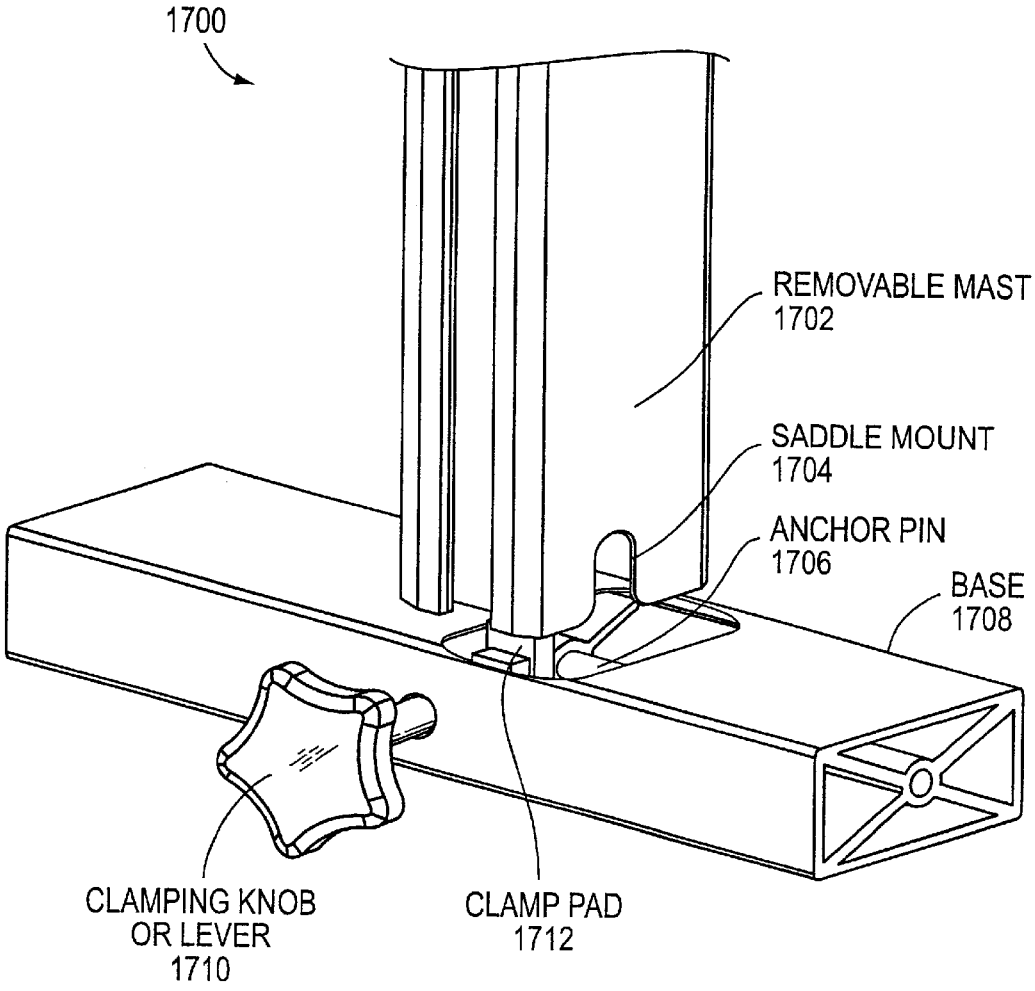
FIG. 17 is a perspective view of a second alternative mast-to-base connection for a lifting device before the mast sections have been connected.
Figure 18:
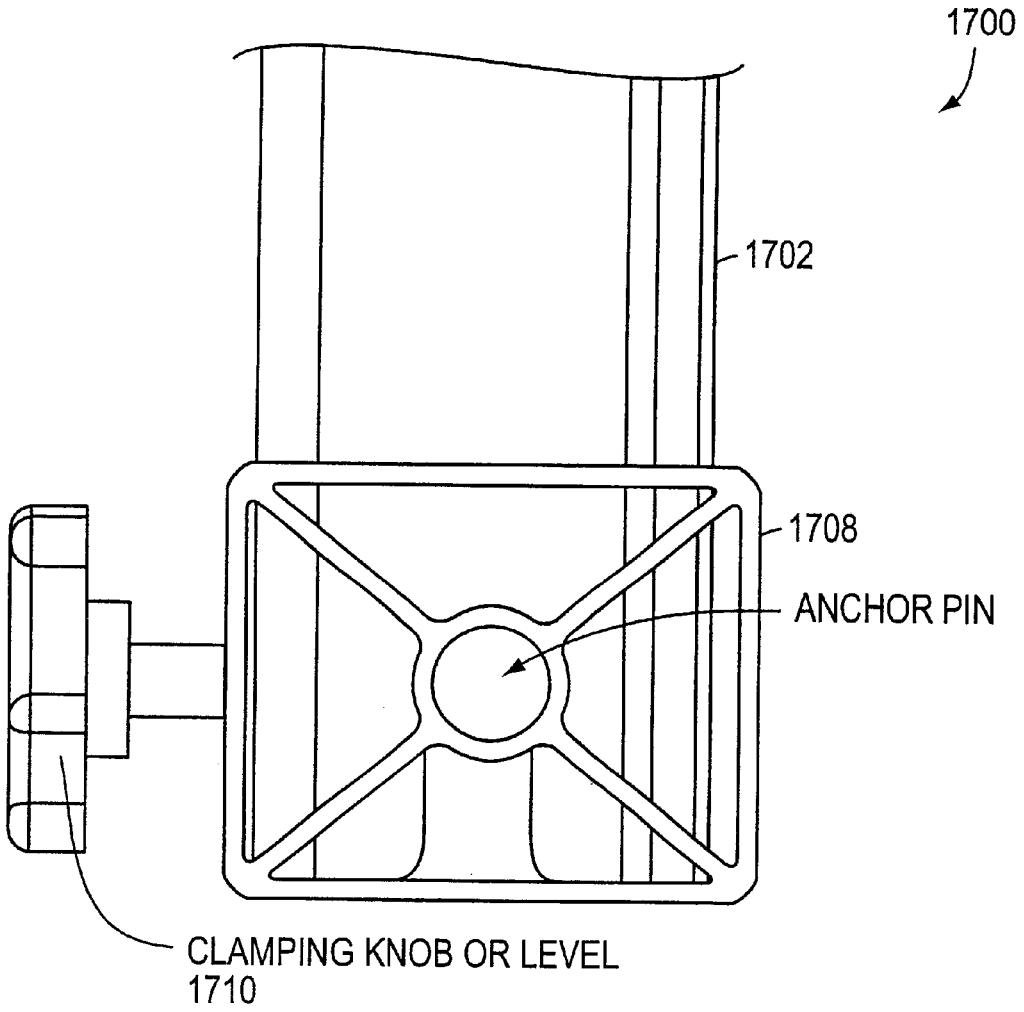
FIG. 18 is a side view of a second alternative mast-to-base connection for a lifting device after the mast sections have been connected.

FIG. 17 is a perspective view illustrating a second alternative mast-to-base connection 1700 including a saddle joint. In this embodiment, the mast 1702 includes a saddle mount 1704 that fits over an anchor pin 1706 carried by the base 1708. A threaded stop 1710 and clamp pad 1712 carried by the base 1708 may be used to secure the mast 1702 to the base 1708 when desired. FIG. 18 is a side view of the saddle join connection 1700 after the mast 1702 has been connected to the base 1708.

Figure 19:
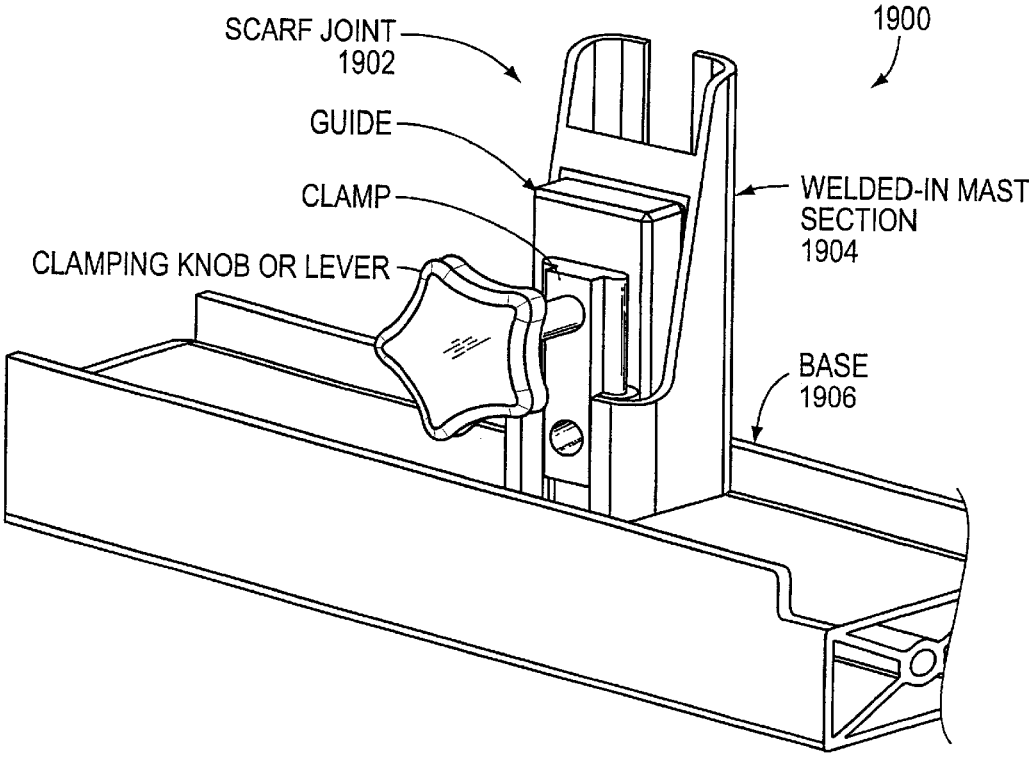
FIG. 19 is a perspective view of a third alternative mast-to-base connection for a lifting device before the mast has been connected to the base.
Figure 20:
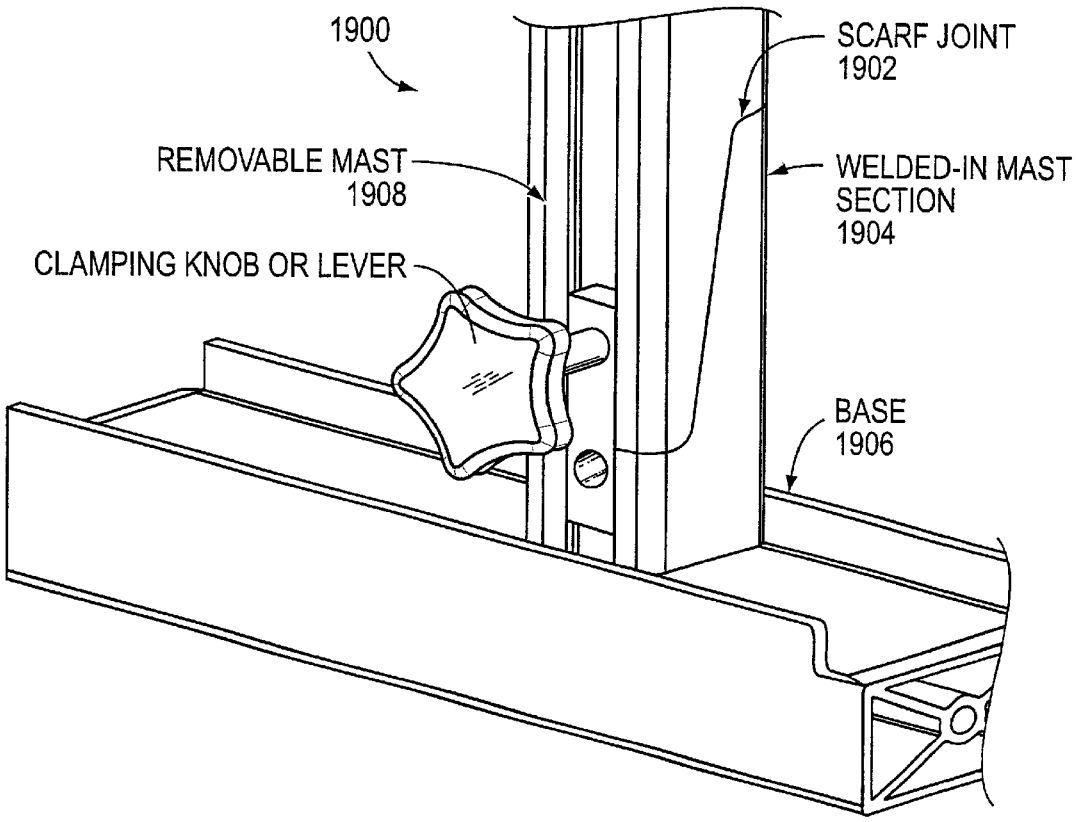
FIG. 20 is a perspective view of a third alternative mast-to-base connection for a lifting device after the mast has been connected to the base.

FIG. 19 is a perspective view of a third alternative mast-to-base connection 1900 before the mast has been connected to the base 1906. This embodiment includes a scarf joint 1902 formed in a short mast section 1904 that is preferably welded or bolted to the base 1906. The scarf joint 1902 may be substantially the same as the scarf joint 1202 described previously with reference to FIGS. 12 and 13. FIG. 20 shows the scarf joint 1902 after the upper mast section 1908 have been connected to the short mast section 1904 that is preferably welded or bolted to the base 1906.

Figure 21:
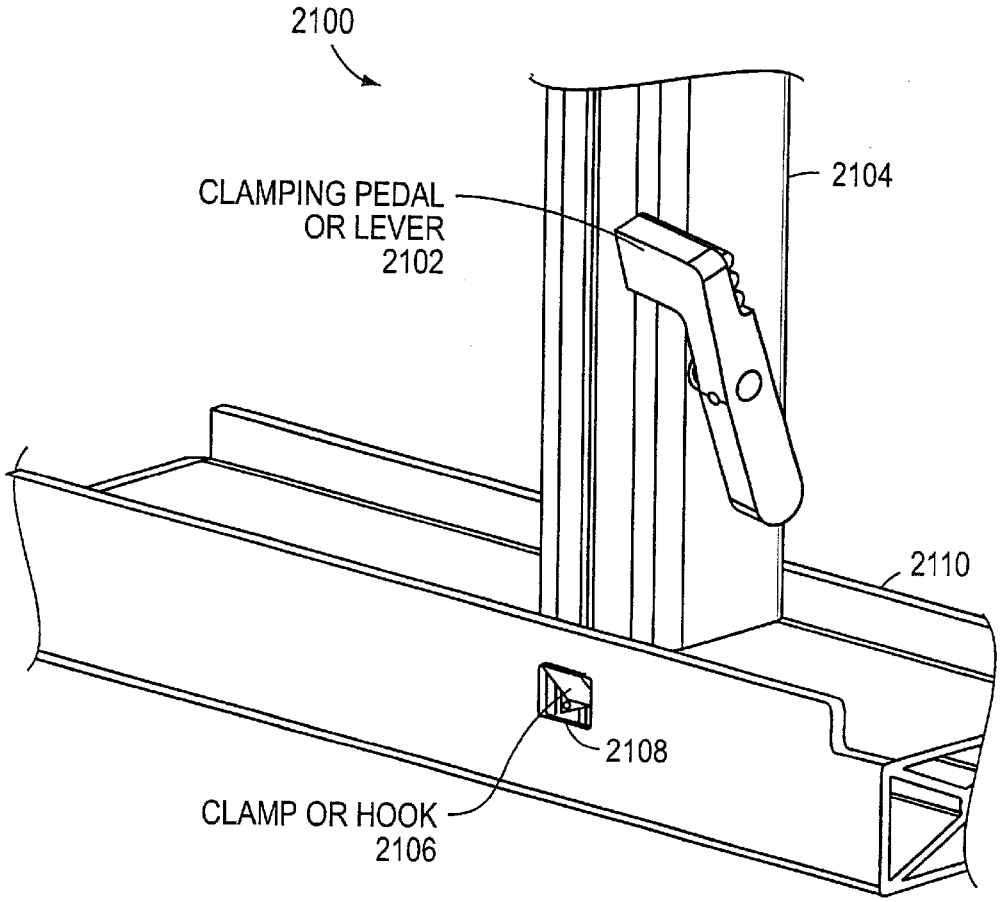
FIG. 21 is a perspective view of a fourth alternative mast-to-base connection for a lifting device.
Figure 22:
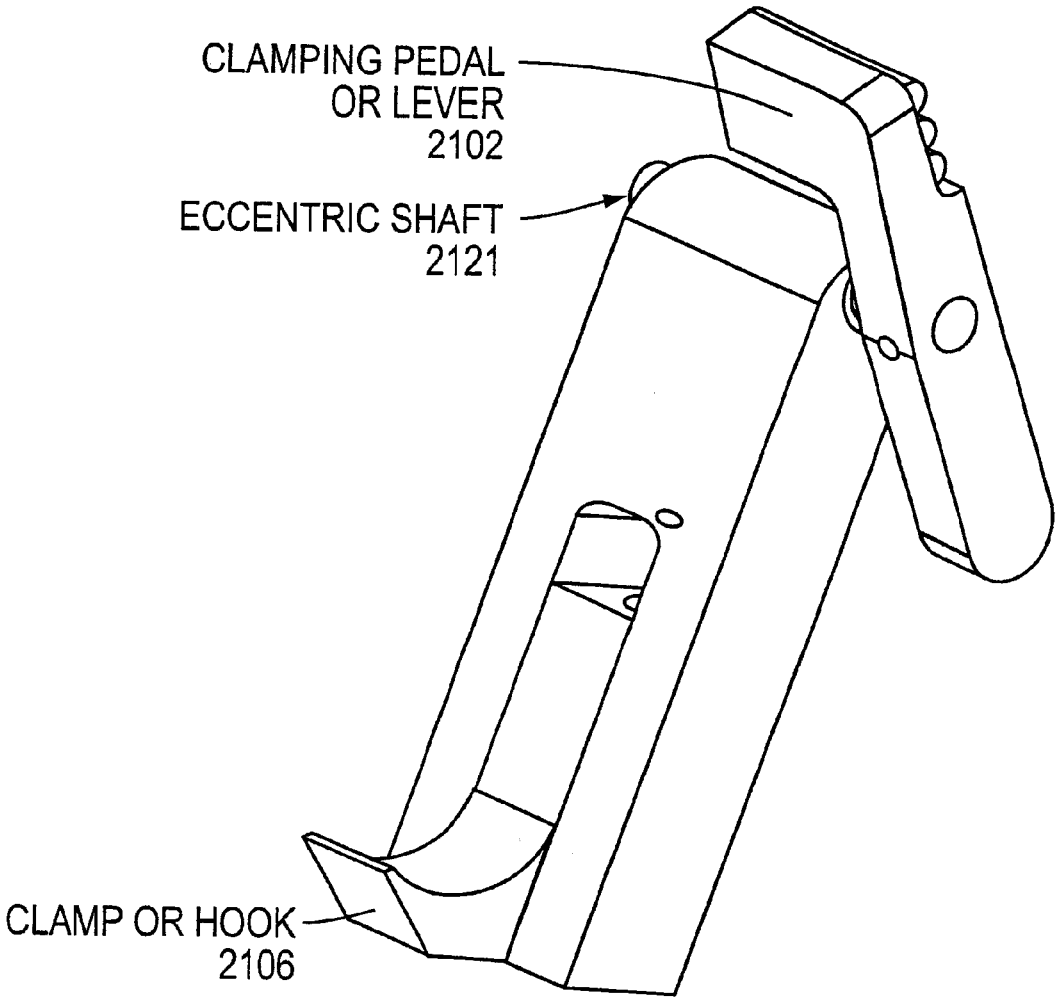
FIG. 22 is a perspective view of a clamp assembly for a fourth alternative mast-to-base connection for a lifting device.

FIG. 21 is a perspective view of a fourth alternative mast-to-base connection 2100 for the lifting device 100 including a lever-and-hook joint. This embodiment includes a pedal or lever 2102 carried on the mast 2104. The pedal or lever 2102 operates a clamp or hook that selectively engages an opening 2108 in the base 2100. FIG. 22 is a perspective view of this clamp assembly, which includes an eccentric shaft 2121 that operates to move the hook 2106 into and out of the opening 2108 upon operation of the petal or lever 2102.

Figure 23:
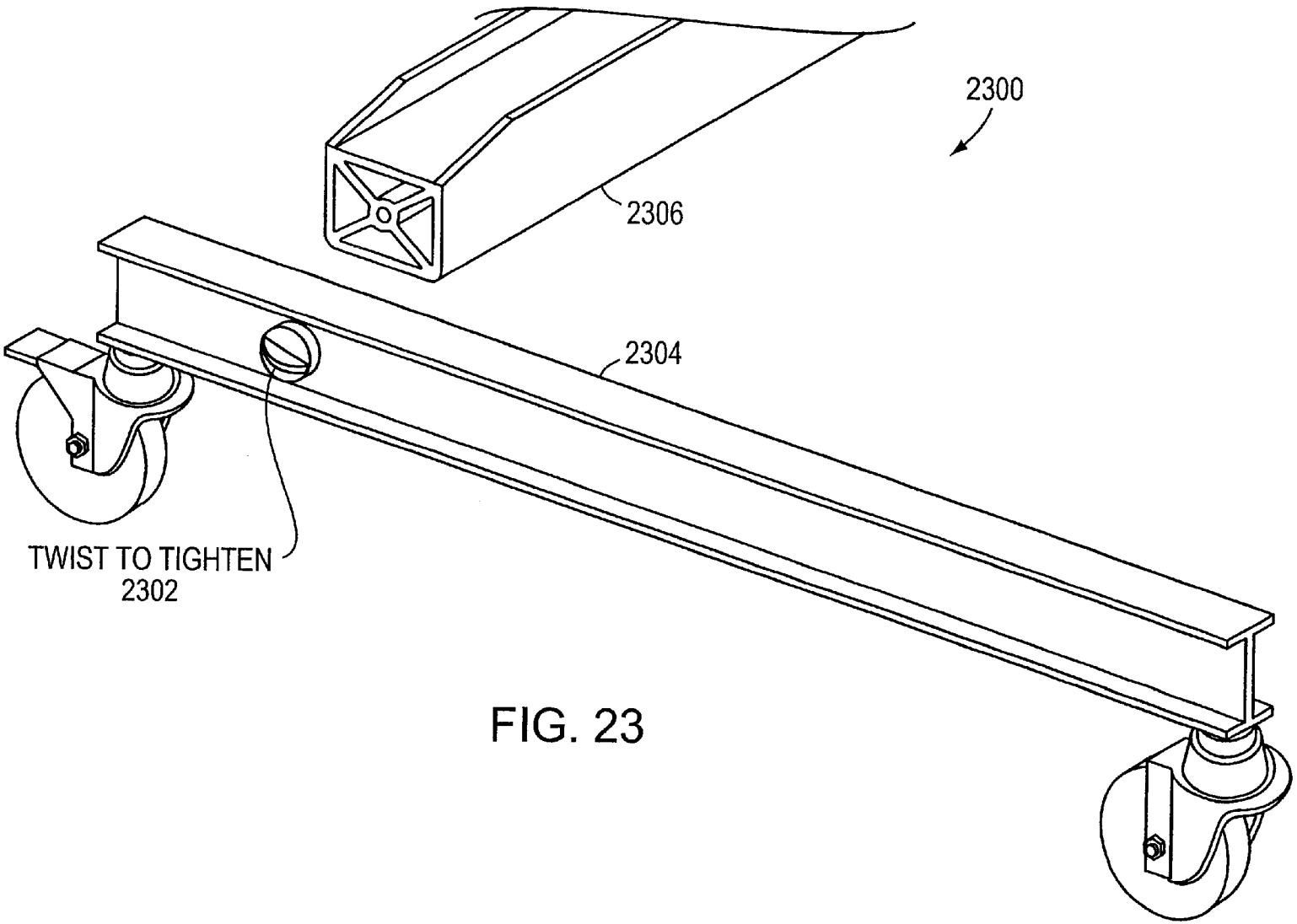
FIG. 23 is a perspective view of a base-to-dolly connection for a lifting device.

FIG. 23 is a perspective view of a base-to-dolly connection 2300 for the lifting device. This embodiments includes a threaded pin 2302 through the dolly leg 2304 that may be screwed into a threaded hole in the base 2306. The threaded pin 2302 is preferably captured so that it cannot be separated from the dolly leg 2304 when the list is disassembled. It should be understood that any of the scarf joint, post-and-channel joint, saddle joint or lever-and-hook joint (or any other suitable type of joint) may be used to removably connect any of the demountable components together, such as the mast sections, the mast and base, or the section of the dolly.

Figure 26:
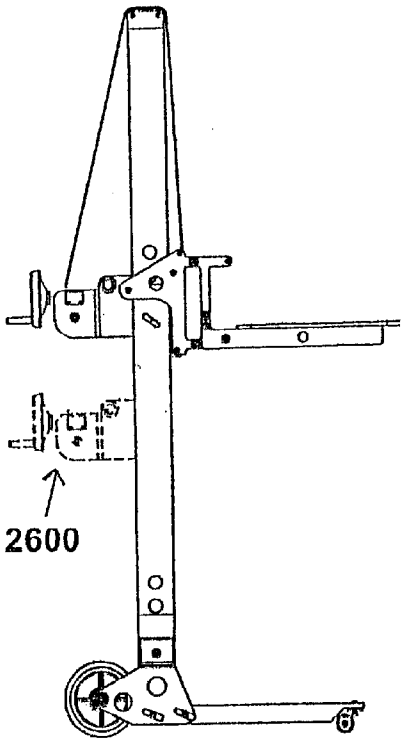
FIG. 26 is a side view of a lifting device with a crank assembly that may be attached to an upper mast assembly or a lower mast assembly.
Figure 25:
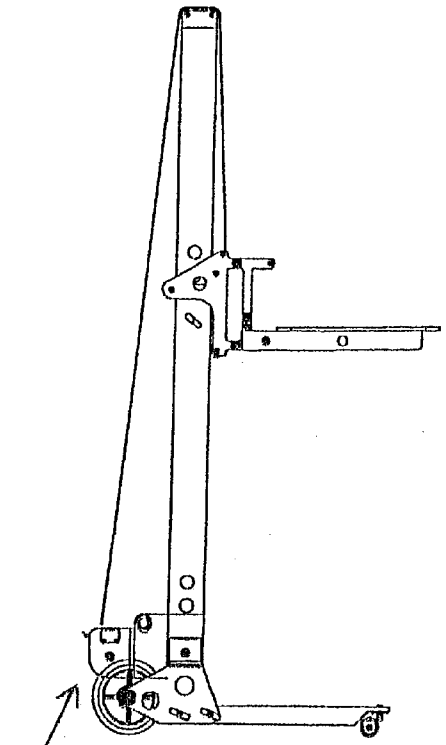
FIG. 25 is a side view of a lifting device with a base-mounted crank assembly.
Figure 24:
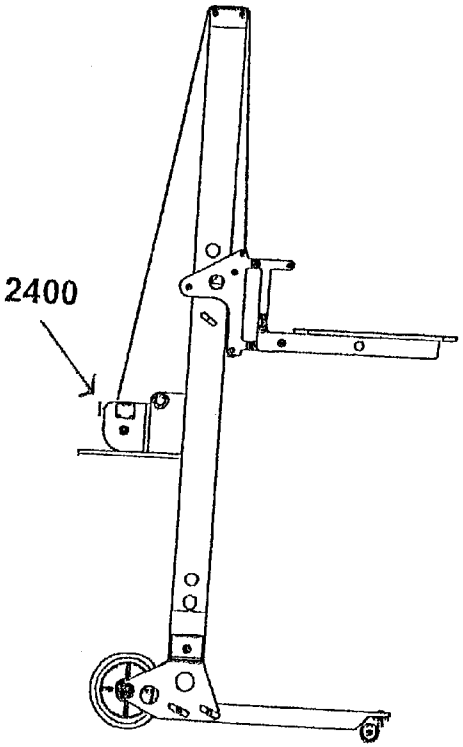
FIG. 24 is a side view of a lifting device with a tray-mounted crank assembly.

In has also been found that it may be desirable to locate the crank 120 in different locations for different applications. For example, FIG. 24 is a side view of a lifting device with a tray-mounted crank assembly 2400. FIG. 25 is a side view of a lifting device with a base-mounted crank assembly 2500. FIG. 26 is a side view of a lifting device with a crank assembly 2600 that may be attached to an upper mast assembly or a lower mast assembly.

Figure 27C:
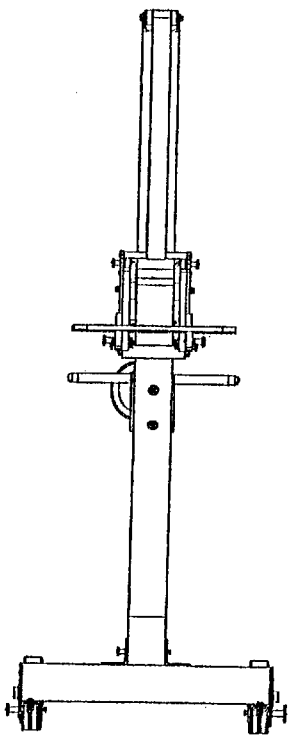
FIG. 27C is a front view of a lifting device with a telescoping mast in a contracted configuration.
Figure 27B:
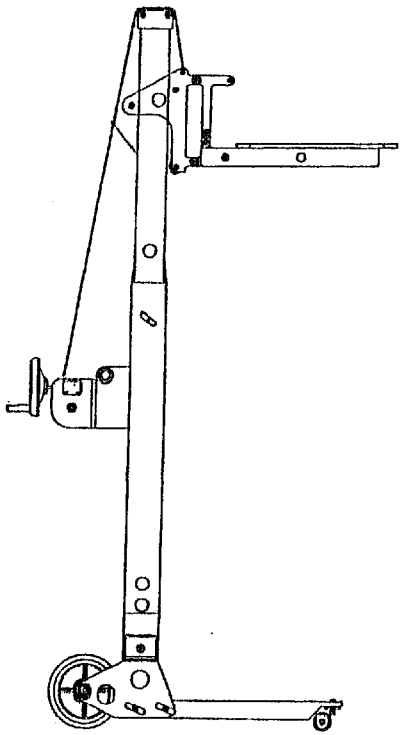
FIG. 27B is a side view of a lifting device with a telescoping mast in an extended configuration.
Figure 27A:
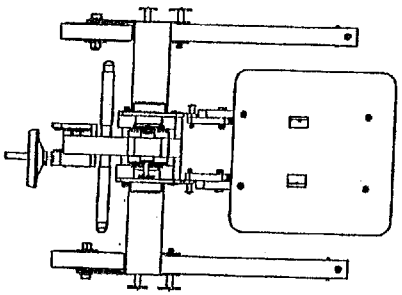
FIG. 27A is a side view of a lifting device with a telescoping mast in a contracted configuration.
Figure 27A:
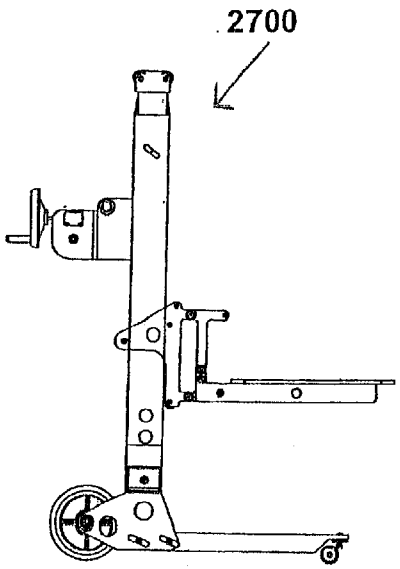
Figure 28A:
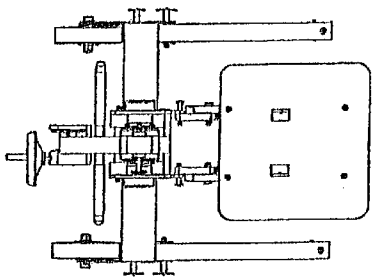
FIG. 28A is a side view of a lifting device with a hinged mast in a contracted configuration.
Figure 28A:
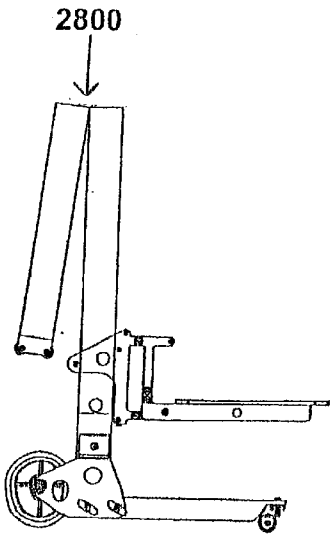
Figure 28B:
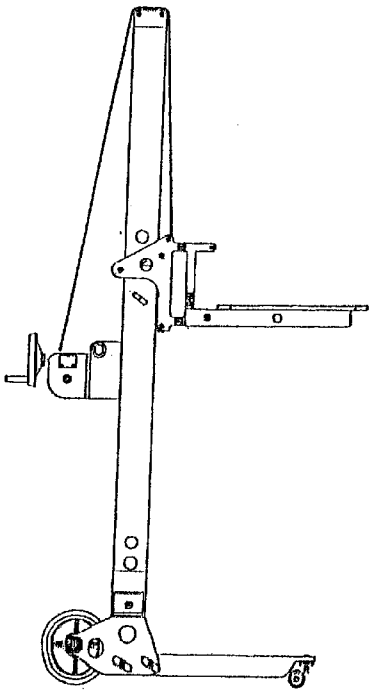
FIG. 28B is a side view of a lifting device with a hinged mast in an extended configuration.
Figure 28C:
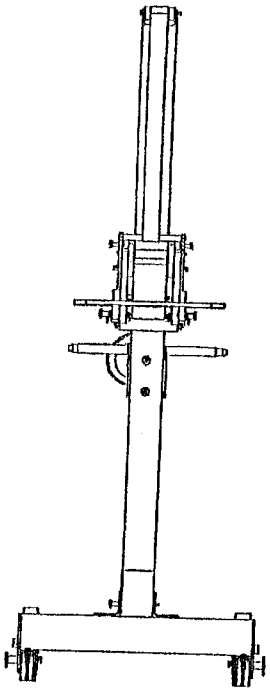
FIG. 28C is a front view of a lifting device with a hinged mast in a contracted configuration.

In has also been found that different types of demounting or folding masts may be desirable for different applications. For example, FIG. 27A is a side view of a lifting device-with a-telescoping mast 2700 in a contracted-configuration. FIG. 27B is a side view of the lifting device with the telescoping mast 2700 in an extended configuration. FIG. 27C is a front view of the lifting device with the telescoping mast 2700 in a contracted configuration. FIG. 28A is a side view of a lifting device with a hinged mast 2800 in a contracted configuration. FIG. 28B is a side view of the lifting device with the hinged mast 2800 in an extended configuration. FIG. 28C is a front view of the lifting device with the hinged mast 2800 in a contracted configuration.

In view of the foregoing, it will be appreciated that present invention provides a demountable lifting device. It should be understood that the foregoing relates only to the exemplary embodiments of the present invention, and that numerous changes may be made therein without departing from the spirit and scope of the invention as defined by the following claims.

The invention claimed is:

1. A lifting device, comprising:

a mast defining a first channel;

a pulley supported by the mast;

an actuator configured to be removably attached to the lifting device;

a carriage slidably received within the first channel of the mast;

a flexible connector having a first end and a second end, the first end coupled to the carriage and the second end coupled to the actuator, the flexible connector extending over the pulley; and the actuator operative to selectively reel the flexible connector in and out when the flexible connector is positioned over the pulley to cause the carriage to move up and down along the mast within a range between an upper position on the first section of the mast and a lower position on the second section of the mast.

2. The lifting device of claim 1, further comprising:

a second channel defined by the mast; and the actuator being movably mountable within the second channel.

3. The lifting device of claim 1, further comprising:

a tray connected to the mast; and the actuator being mounted to the tray.

4. The lifting device of claim 1, further comprising:

a base supporting the mast; and the actuator being mounted to the base.

5. The lifting device of claim 1, wherein:

the mast is separable into multiple mast sections, and the mast sections are removably connected together by a scarf joint.

6. The lifting device of claim 1, wherein:

the mast is separable into multiple mast sections, and the mast sections are removably connected together by a post-and-channel joint.

7. The lifting device of claim 1, wherein:

the mast is supported by a base, and the mast is removably connected to the base by a scarf joint.

8. The lifting device of claim 1, wherein:

the mast is supported by a base, and the mast is removably connected to the base by a post-and-channel joint.

9. The lifting device of claim 1, wherein:

the mast is supported by a base, and the mast is removably connected to the base by a saddle joint.

10. The lifting device of claim 1, wherein:

the mast is supported by a base, and the mast is removably connected to the base by a lever-and-hook joint.

11. A lifting device, comprising:

a mast defining a first channel and a second channel;

a pulley supported by the mast;

an actuator configured to be removably received within the second channel and securable at a various positions along the mast;

a carriage slidably received within the first channel of the mast;

a flexible connector having a first end and a second end, the first end coupled to the carriage and the second end coupled to the actuator, the flexible connector extending over the pulley; and the actuator operative to selectively reel the flexible connector in and out when the flexible connector is positioned over the pulley to cause the carriage to move up and down along the mast within a range between an upper position on the first section of the mast and a lower position on the second section of the mast.

12. The lifting device of claim 11, wherein:

the mast is separable into multiple mast sections, and the mast sections are removably connected together by a scarf joint.

13. The lifting device of claim 11, wherein:

the mast is separable into multiple mast sections, and the mast sections are removably connected together by a post-and-channel joint.

14. The lifting device of claim 11, wherein:

the mast is supported by a base, and the mast is removably connected to the base by a scarf joint.

15. The lifting device of claim 11, wherein:

the mast is supported by a base, and the mast is removably connected to the base by a post-and-channel joint.

16. The lifting device of claim 11, wherein:

the mast is supported by a base, and the mast is removably connected to the base by a saddle joint.

17. The lifting device of claim 11, wherein:

the mast is supported by a base, and the mast is removably connected to the base by a lever-and-hook joint.

18. A lifting device, comprising:

a mast defining a first channel and a second channel;

a pulley supported by the mast;

an actuator configured to be removably received within the second channel and securable at a various positions along the mast;

a carriage slidably received within the first channel of the mast;

a flexible connector having a first end and a second end, the first end coupled to the carriage and the second end coupled to the actuator, the flexible connector extending over the pulley;

the actuator operative to selectively-reel the flexible connector in and out when the flexible connector is positioned over the pulley to cause the carriage to move up and down along the mast within a range between an upper position on the first section of the mast and a lower position on the second section of the mast;

a base supporting the mast;

the mast being separable into a plurality of sections; and the mast being separable from the base.

19. The lifting device of claim 18, wherein the mast sections are removably connected together by a joint selected from the group consisting essentially of: a scarf joint, post-and-channel joint, saddle joint, a lever-and-hook joint, a hinged joint, a telescoping joint.

20. The lifting device of claim 18, wherein the mast is removably connected to the base by a joint selected from the group consisting essentially of: a scarf joint, post-and-channel joint, saddle joint, and lever-and-hook joint.

* * * * *